United States Patent [19]

House

[11] Patent Number: 4,490,458

[45] Date of Patent: Dec. 25, 1984

[54] MULTICOLOR PHOTOGRAPHIC ELEMENTS CONTAINING SILVER IODIDE GRAINS

[75] Inventor: Gary L. House, Rochester, N.Y.

[73] Assignee: Eastman Kodak Company, Rochester, N.Y.

[21] Appl. No.: 543,656

[22] Filed: Oct. 19, 1983

Related U.S. Application Data

[63] Continuation-in-part of Ser. No. 451,366, Dec. 20, 1982, abandoned.

[51] Int. Cl.[3] ..... G03C 1/02; G03C 7/26

[52] U.S. Cl. ..... 430/503; 430/434; 430/550; 430/567; 430/569

[58] Field of Search ..... 430/567, 569, 503, 550, 430/434

[56] References Cited

U.S. PATENT DOCUMENTS

| | | | |
|---|---|---|---|
| 4,094,684 | 6/1978 | Maskasky . | |
| 4,142,900 | 3/1979 | Maskasky . | |
| 4,435,501 | 3/1984 | Maskasky | 430/434 |
| 4,439,520 | 3/1984 | Kofron | 430/434 |
| 4,459,353 | 7/1984 | Maskasky | 430/567 |

FOREIGN PATENT DOCUMENTS

| | | |
|---|---|---|
| 505012 | 8/1930 | Fed. Rep. of Germany . |
| 2053499A | 2/1981 | United Kingdom . |

OTHER PUBLICATIONS

Kofron et al., U.S. Ser. No. 429,407, filed Sep. 30, 1982 titled Sensitized High Aspect Ratio Silver Halide Emulsions and Photographic Elements.

Jones and Hill, U.S. Ser. No. 430,092 filed Sep. 30, 1982 titled Photographic Image Transfer Film Unit.

Maskasky, U.S. Ser. No. 431,855, filed Sep. 30, 1982 titled Controlled Site Epitaxial Sensitization.

Steigman, Photographische Industrie, "Green- and Brown-Developing Emulsions", vol. 34, pp. 764, 766, and 872 published Jul. 8 and Aug. 5, 1938.

Maskasky, *Research Disclosure*, vol. 181, May 1979, Item 18153.

Byerley and Hirsch, "Dispersions of Metastable High Temperature Cubic Silver Iodide", *Journal of Photographic Science*, vol. 18, 1970, pp. 53-59.

James, *The Theory of the Photographic Process*, 4th Ed., Macmillan, 1977, pp. 1 and 2.

Ozaki and Hachisu, "Photophoresis and Photoagglomeration of Plate-Like Silver Iodide Particles", *Science of Light*, vol. 19, No. 2, 1970, pp. 59-71.

Zharkov, Dobroserdova, and Panfilova, "Crystallization of Silver Halides in Photographic Emulsions IV, Study by Electron Microscopy of Silver Iodide Emulsions", *Zh. Nauch. Prikl. Fot. Kine*, Mar.-Apr., 1957, 2, pp. 102-105.

Daubendiek, "AgI Precipitations: Effects of pAg on Crystal Growth(PB), III-23", *Papers from the 1978 International Congress of Photographic Science*, Rochester, New York, pp. 140-143, 1978.

Maskasky, U.S. Ser. No. 451,309, filed Dec. 20, 1982 titled Gamma Phase Silver Iodide Emulsions, Photographic Elements Containing These Emulsions, and Processes for Their Use.

*Primary Examiner*—Mary F. Downey

*Attorney, Agent, or Firm*—Carl O. Thomas

[57] ABSTRACT

Multicolor photographic elements are disclosed each containing superimposed emulsion layers for separately recording blue and minus blue light including at least one emulsion layer comprised of a dispersing medium and silver halide grains, wherein at least 50 percent of the total projected area of the silver halide grains is provided by thin tabular silver iodide grains having a thickness of less than 0.3 micron and an average aspect ratio of greater than 8:1. The multicolor photographic elements show advantages in the minus blue recording emulsion layers directly attributable to the thin tabular silver iodide grains.

19 Claims, 9 Drawing Figures

1μm

MULTICOLOR PHOTOGRAPHIC ELEMENTS CONTAINING SILVER IODIDE GRAINS

FIELD OF THE INVENTION

The invention relates to silver halide photographic elements capable of producing multicolor images and to processes for their use.

BACKGROUND OF THE INVENTION

Kofron et al U.S. Ser. No. 429,407, filed Sept. 30, 1982, titled SENSITIZED HIGH ASPECT RATIO SILVER HALIDE EMULSIONS AND PHOTOGRAPHIC ELEMENTS, commonly assigned, discloses multicolor photographic elements in which at least one of the blue, green, and red recording emulsion layers is comprised of a dispersing medium and silver halide grains, wherein at least 50 percent of the total projected area of the silver halide grains is provided by chemically and spectrally sensitized tabular silver halide grains having a thickness of less than 0.3 micron, a diameter of at least 0.6 micron, and an average aspect ratio of greater than 8:1. Kofron et al specifically discloses the use of high aspect ratio tabular grain emulsions in which the tabular grains are comprised of silver bromoiodide (iodide being limited by its solubility in silver bromide to about 40 mole percent), silver bromide, silver chloride, silver chloride containing minor amounts of bromide and/or iodide, and silver chlorobromide. (Except as otherwise indicated, all references to halide percentages are based on silver present in the corresponding emulsion, grain, or grain region being discussed; e.g., a grain consisting of silver bromoiodide containing 40 mole percent iodide also contains 60 mole percent bromide.) Kofron et al contains no disclosure of high aspect ratio tabular grain silver iodide emulsions, and, because of the rarity with which silver iodide emulsions are employed in multicolor photographic elements, bases its teachings on the properties of the silver halides more commonly employed in multicolor photography. For example, Kofron et al teaches increasing the permissible maximum thickness of the tabular grains from 0.3 micron to 0.5 micron to increase blue light absorption, recognizing that the thicker tabular grains are better able to assist the blue spectral sensitizing dyes in absorbing blue light. Further, Kofron et al discusses multicolor photographic elements in which high aspect ratio tabular grain blue recording emulsion layers overlie minus blue (green and/or red) recording emulsion layers and discusses the effects of blue light reaching these minus blue recording emulsion layers. Jones and Hill U.S. Ser. No. 430,092, filed Sept. 30, 1982, titled PHOTOGRAPHIC IMAGE TRANSFER FILM UNIT, commonly assigned, is essentially cumulative in its teachings, but is directed specifically to image transfer film units. Maskasky U.S. Ser. No. 431,855, filed Sept. 30, 1982, titled CONTROLLED SITE EPITAXIAL SENSITIZATION, commonly assigned is essentially cumulative in its teachings, but is directed specifically to the sensitization of high aspect ratio tabular grains by silver salt epitaxy.

Radiation-sensitive silver iodide emulsions, though infrequently employed in photography, are known in the art. Silver halide emulsions which employ grains containing silver iodide as a separate and distinct phase are illustrated by Steigmann German Pat. No. 505,012, issued Aug. 12, 1930; Steigmann, Photographische Industrie, "Green- and Brown-Developing Emulsions", Vol. 34, pp. 764, 766, and 872, published July 8 and August 5, 1938; Maskasky U.S. Pat. Nos. 4,094,684 and 4,142,900; and Koitabashi et al U.K. patent application No. 2,063,499A. Maskasky *Research Disclosure*, Vol. 18153, May 1979. Item 18153, reports silver iodide phosphate photophic emulsions in which silver is coprecipitated with iodide and phosphate. A separate silver iodide phase is not reported.

The crystal structure of silver iodide has been studied by crystallographers, particularly by those interested in photography. As illustrated by Byerley and Hirsch, "Dispersions of Metastable High Temperature Cubic Silver Iodide", *Journal of Photographic Science*, Vol. 18, 1970, pp. 53-59, it is generally recognized that silver iodide is capable of existing in three different crystal forms. The most commonly encountered form of silver iodide crystals is the hexagonal wurtzite type, designated $\beta$ phase silver iodide. Silver iodide is also stable at room temperature in its face centered cubic crystalline form, designated $\gamma$ phase silver iodide. A third form of crystalline silver iodide, stable only at temperatures above about 147° C., is the body centered cubic form, designated $\alpha$ phase silver iodide. The $\beta$ phase is the most stable form of silver iodide.

James, *The Theory of the Photographic Process*, 4th Ed., Macmillan, 1977, pp. 1 and 2, contains the following summary of the knowledge of the art:

> According to the conclusions of Kokmeijer and Van Hengel, which have been widely accepted, more nearly cubic AgI is precipitated when silver ions are in excess and more nearly hexagonal AgI when iodide ions are in excess. More recent measurements indicate that the presence or absence of gelatin and the rate of addition of the reactants have pronounced effects on the amounts of cubic and hexagonal AgI. Entirely hexagonal material was produced only when gelatin was present and the solutions were added slowly without an excess of either Ag or $^{+}I^{-}$. No condition was found where only cubic material was observed.

Tabular silver iodide crystals have been observed. Preparations with an excess of iodide ions, producing hexagonal crystal structures of predominantly $\beta$ phase silver iodide are reported by Ozaki and Hachisu, "Photophoresis and Photoagglomeration of Plate-like Silver Iodide Particles", *Science of Light*, Vol. 19, No. 2, 1970, pp. 59-71, and Zharkov, Dobroserdova, and Panfilova, "Crystallization of Silver Halides in Photographic Emulsions IV. Study by Electron Microscopy of Silver Iodide Emulsions", *Zh. Nauch. Prikl. Fot. Kine.* March-April, 1957, 2, pp. 102-105.

Daubendiek, "AgI Precipitations: Effects of pAg on Crystal Growth(PB), III-23", *Papers from the 1978 International Congress of Photographic Science*, Rochester, New York, pp. 140-143, 1978, reports the formation of tabular silver iodide grains during double-jet precipitations at a pAg of 1.5. Because of the excess of silver ions during precipitation, it is believed that these tabular grains were of face centered cubic crystal structure. However, the average aspect ratio of the grains was low, being estimated at substantially less than 5:1.

Maskasky U.S. Ser. No. 451,309 filed Dec. 20, 1982, and commonly assigned, titled GAMMA PHASE SILVER IODIDE EMULSIONS, PHOTOGRAPHIC ELEMENTS CONTAINING THESE EMULSIONS, AND PROCESSES FOR THEIR USE, discloses the first high aspect ratio tabular grain silver iodide emulsions in which the grains are of a face centered cubic crystal structure, as is characteristic of silver iodide.

SUMMARY OF THE INVENTION

In one aspect this invention is directed to a photographic element capable of producing a multicolor image comprised of a support and, located on the support, superimposed emulsion layers for facilitating separate recording of blue, green, and red light, each comprised of a dispersing medium and silver halide grains. The improvement comprises at least 50 percent of the total projected area of the silver halide grains in at least one emulsion layer being provided by thin tabular silver iodide grains having a thickness of less than 0.3 micron and an average aspect ratio of greater than 8:1.

In another aspect, the invention is directed to producing a visible photographic image by processing in an aqueous alkaline solution in the presence of a developing agent an imagewise exposed photographic element as described above.

The multicolor photographic elements of this invention exhibit high efficiencies in the absorption of blue light. They can display reduced color contamination of minus blue (i.e., red and/or green) records by blue light. The multicolor photographic elements of this invention can eliminate yellow filter layers without exhibiting color contamination of the minus blue record. In addition the multicolor elements of this invention can exhibit improvements in image sharpness and in speed-grain relationships of the minus blue records.

Although the invention has been described with reference to certain specific advantages, other advantages will become apparent in the course of the detailed description of preferred embodiments.

DESCRIPTION OF PREFERRED EMBODIMENTS

Figure 1:
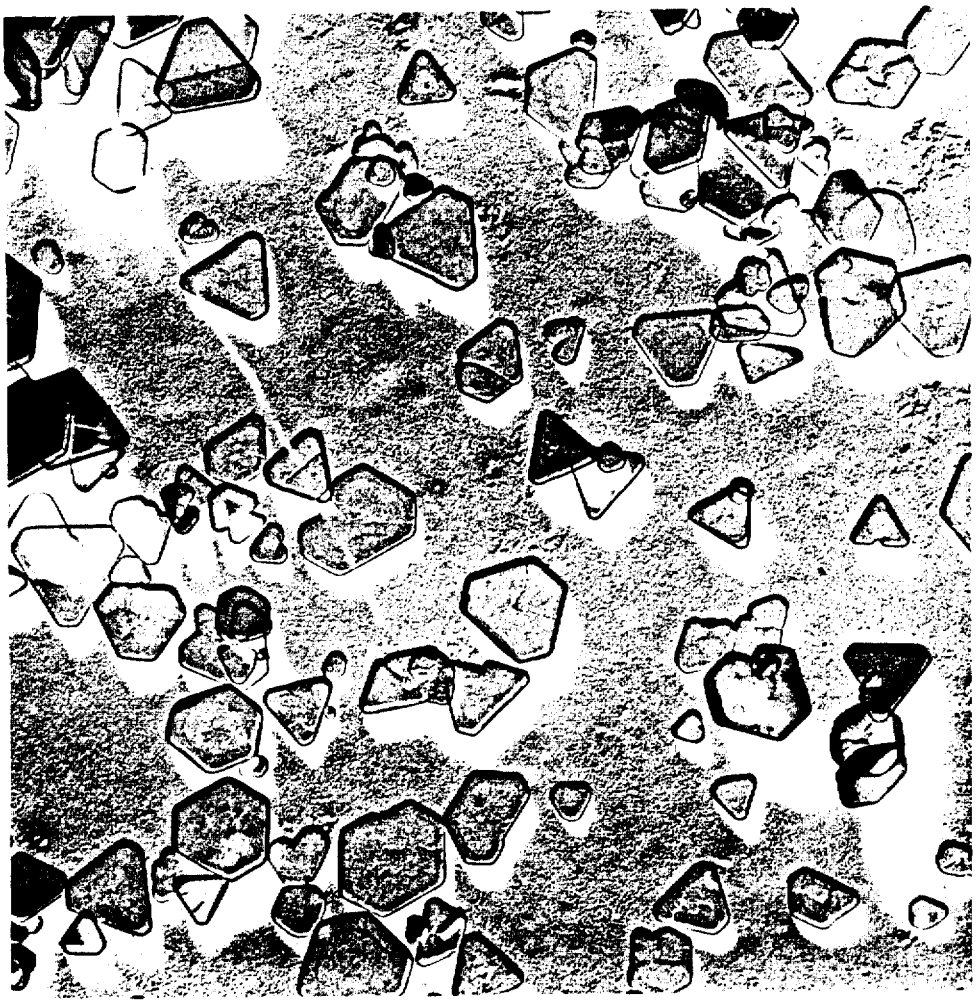
FIGS. 1 through 6 are photomicrographs of high aspect ratio tabular grain emulsions.

This invention is directed to photographic elements capable of producing multicolor images and to processes for their use. The multicolor photographic elements of this invention each incorporate at least one silver halide emulsion layer comprised of a dispersing medium and silver halide grains. At least 50 percent of the total projected area of the silver halide grains in the blue recording emulsion layer is provided by thin tabular grains having a thickness of less than 0.3 micron and an average aspect ratio of greater than 8:1. This emulsion layer is preferably a blue recording emulsion layer and is for convenience described below with reference to this use.

In addition to at least one blue recording emulsion layer as described above the multicolor photographic elements additionally include at least one green recording silver halide emulsion layer and at least one red recording silver halide emulsion layer. The multicolor photographic elements can also optionally include one or more additional blue recording emulsion layers. All of these additional emulsion layers can be chosen from among conventional multicolor photographic element emulsion layers. In a preferred form at least one green recording emulsion layer and at least one red recording emulsion layer are also comprised of high aspect ratio tabular grain emulsions. In certain preferred forms of the invention all of the emulsion layers can be comprised of high aspect ratio tabular grain emulsions. Tabular silver iodide grains satisfying the same general requirements as those of the blue recording emulsion layer described above can be present in any or all of these additional emulsion layers, or high aspect ratio tabular grain silver halide emulsions of other halide compositions can be present in any or all of these additional emulsion layers.

As applied to the silver halide emulsions of the present invention the term "high aspect ratio" is herein defined as requiring that the silver halide grains having a thickness of less than 0.3 micron have an average aspect ratio of greater than 8:1 and account for at least 50 percent of the total projected area of the silver halide grains. The preferred high aspect ratio tabular grain silver halide emulsions of the present invention are those wherein the silver halide grains having a thickness of less than 0.3 micron (optimally less than 0.2 micron) have an average aspect ratio of at least 12:1 and optimally at least 20:1.

It is appreciated that the thinner the tabular grains accounting for a given percentage of the projected area, the higher the average aspect ratio of the emulsion. Individual tabular silver iodide grains have been observed having thicknesses slightly in excess of 0.005 micron, suggesting that preparations of tabular silver iodide grains according to this invention having average thicknesses down to that value or at least 0.01 micron are feasible. It is a distinct advantage of high aspect ratio tabular silver iodide grains that they can be prepared at thicknesses less than high aspect ratio tabular grains of other halide compositions. Minimum tabular grain thicknesses of 0.03 micron for high aspect ratio tabular grain emulsions are generally contemplated, these being particularly readily achieved for silver bromide and silver bromoiodide tabular grain emulsions.

The grain characteristics described above of the high aspect ratio tabular grain emulsions can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph (or an electron micrograph) of an emulsion sample. From shadowed electron micrographs of emulsion samples it is possible to determine the thickness and diameter of each grain and to identify those tabular grains having a thickness of less than 0.3 micron. From this the aspect ratio of each such tabular grain can be calculated, and the aspect ratios of all the tabular grains in the sample meeting the less than 0.3 micron thickness criterion can be averaged to obtain their average aspect ratio. By this definition the average aspect ratio is the average of individual tabular grain aspect ratios. In practice it is usually simpler to obtain an average thickness and an average diameter of the tabular grains having a thickness of less than 0.3 micron and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the silver iodide grains meeting the thickness and diameter criteria can be summed, the projected areas of the remaining silver iodide grains in the photomicrograph can be summed separately, and from the two sums the percentage of the total projected area of the silver iodide grains provided by the grains meeting the thickness and diameter critera can be calculated.

In the above determinations a reference tabular grain thickness of less than 0.3 micron was chosen to distinguish the uniquely thin tabular grains herein contemplated from thicker tabular grains which provide inferior photographic properties. At lower diameters it is not always possible to distinguish tabular and nontabular grains in micrographs. The tabular grains for purposes of this disclosure are those which are less than 0.3 micron in thickness and appear tabular at 2,500 times magnification. The term "projected area" is used in the same sense as the terms "projection area" and "projective area" commonly employed in the art; see, for example, James and Higgins, *Fundamentals of Photographic Theory*, Morgan and Morgan, New York, p. 15.

In a preferred form offering a broad range of observed advantages the present invention employs, in addition to high aspect ratio silver iodide emulsions, high aspect ratio silver bromoiodide emulsions. High aspect ratio silver bromoiodide emulsions and their preparation is the subject of Wilgus and Haefner U.S. Ser. No. 429,420, filed Sept. 30, 1982, commonly assigned, titled HIGH ASPECT RATIO SILVER BROMOIODIDE EMULSIONS AND PROCESSES FOR THEIR PREPARATION, here incorporated by reference.

High aspect ratio tabular grain silver bromoiodide emulsions can be prepared by a precipitation process which forms a part of the Wilgus and Haefner invention. Into a conventional reaction vessel for silver halide precipitation, equipped with an efficient stirring mechanism, is introduced a dispersing medium. Typically the dispersing medium initially introduced into the reaction vessel is at least about 10 percent, preferably 20 to 80 percent, by weight based on total weight of the dispersing medium present in the silver bromoiodide emulsion at the conclusion of grain precipitation. Since dispersing medium can be removed from the reaction vessel by ultrafiltration during silver bromoiodide grain precipitation, as taught by Mignot U.S. Pat. No. 4,334,012, here incorporated by reference, it is appreciated that the volume of dispersing medium initially present in the reaction vessel can equal or even exceed the volume of the silver bromoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of silver bromoiodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

A minor portion, typically less than 10 percent, of the bromide salt employed in forming the silver bromoiodide grains is initially present in the reaction vessel to adjust the bromide ion concentration of the dispersing medium at the outset of silver bromoiodide precipitation. Also, the dispersing medium in the reaction vessel is initially substantially free of iodide ions, since the presence of iodide ions prior to concurrent introducton of silver and bromide salts favors the formation of thick and nontabular grains. As employed herein, the term "substantially free of iodide ions" as applied to the contents of the reaction vessel means that there are insufficient iodide ions present as compared to bromide ions to precipitate as a separate silver iodide phase. It is preferred to maintain the iodide concentration in the reaction vessel prior to silver salt introduction at less than 0.5 mole percent of the total halide ion concentration present. If the pBr of the dispersing medium is initially too high, the tabular silver bromoiodide grains produced will be comparatively thick and therefore of low aspect ratios. It is contemplated to maintain the pBr of the reaction vessel initially at or below 1.6, preferably below 1.5. On the other hand, if the pBr is too low, the formation of nontubular silver bromoiodide grains is favored. Therefore, it is contemplated to maintain the pBr of the reaction vessel at or above 1.1. (As herein employed, pBr is defined as the negative logarithm of bromide ion concentration. pH, pCl, pI, and pAg are similarly defined for hydrogen, chloride, iodide, and silver ion concentrations, respectively.)

During precipitation silver, bromide, and iodide salts are added to the reaction vessel by techniques well known in the precipitation of silver bromoiodide grains. Typically an aqueous solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium) halide salts. The silver salt is at least initially introduced into the reaction vessel separately from the iodide salt. The iodide and bromide salts can be added to the reaction vessel separately or as a mixture.

With the introduction of silver salt into the reaction vessel the nucleation stage of grain formation is initiated. A population of grain nuclei is formed which is capable of serving as precipitation sites for silver bromide and silver iodide as the introduction of silver, bromide, and iodide salts continues. The precipitation of silver bromide and silver iodide onto existing grain nuclei constitutes the growth stage of grain formation. The aspect ratios of the tabular grains formed according to this invention are less affected by iodide and bromide concentrations during the growth stage than during the nucleation stage. It is therefore possible during the growth stage to increase the permissible latitude of pBr during concurrent introduction of silver, bromide, and iodide salts above 0.6, preferably in the range of from about 0.6 to 2.2, most preferably from about 0.8 to about 1.6, the latter being particularly preferred where a substantial rate of grain nuclei formation continues throughout the introduction of silver, bromide, and iodide salts, such as in the preparation of highly polydispersed emulsions. Raising pBr values above 2.2 during tabular grain growth results in thickening of the grains, but can be tolerated in many instances while still realizing an average aspect ratio of greater than 8:1.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grain size is such that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver iodide, and/or silver bromoiodide grains can be introduced. (Since bromide and/or iodide is precipitated in preference to chloride, it is also possible to employ silver chlorobromide and silver chlorobromoiodide grains.) The silver halide grains are preferably very fine—e.g., less than 0.1 micron in mean diameter.

Subject to the pBr requirements set forth above, the concentrations and rates of silver, bromide, and iodide salt introductions can take any convenient conventional form. The silver and halide salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction during the run. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Satio U.S. Pat. No. 4,242,445, Wilgus German OLS No. 2,107,118, Teitscheid et al European patent application No. 80102242, and Wey "Growth Mechanism of AgBr Crystals in Gelatin Solution", *Photographic Science and Engineering*, Vol. 21, No. 1, January/February 1977, p. 14, et. seq. By avoiding the formation of additional grain nuclei after passing into the growth stage of precipitation, relatively monodispersed tabular silver bromoiodide grain populations can be obtained. Emulsions having coefficients of variation of less than about 30 percent can be prepared. (As employed herein the coefficient of variation is defined as 100 times the standard deviation of the grain diameter divided by the average grain diameter.) By intentionally favoring renucleation during the growth stage of precipitation, it is, of course, possible to produce polydispersed emulsions of substantially higher coefficients of variation.

The concentration of iodide in the silver bromoiodide emulsions can be controlled by the introduction of iodide salts. Any conventional iodide concentration can be employed. Even very small amounts of iodide—e.g., as low as 0.05 mole percent—are recognized in the art to be beneficial. In their preferred form the emulsions of the present invention incorporate at least about 0.1 mole percent iodide. Silver iodide can be incorporated into the tabular silver bromoiodide grains up to its solubility limit in silver bromide at the temperature of grain formation. Thus, silver iodide concentrations of up to about 40 mole percent in the tabular silver bromoiodide grains can be achieved at precipitation temperatures of 90° C. In practice precipitation temperatures can range down to near ambient room temperatures—e.g., about 30° C. It is generally preferred that precipitation be undertaken at temperatures in the range of from 40° to 80° C.

The relative proportion of iodide and bromide salts introduced into the reaction vessel during precipitation can be maintained in a fixed ratio to form a substantially uniform iodide profile in the tabular silver bromoiodide grains or varied to achieve differing photographic effects. Solberg et al U.S. Ser. No. 431,913, filed Sept. 30, 1982, commonly assigned, titled RADIATION-SENSITIVE SILVER BROMOIODIDE EMULSIONS, PHOTOGRAPHIC ELEMENTS, AND PROCESSES FOR THEIR USE, which is a continuation-in-part of U.S. Ser. No. 320,909, filed Nov. 12, 1981, now abandoned, has recognized specific photographic advantages to result from increasing the proportion of iodide in annular or otherwise laterally displaced regions of high aspect ratio tabular grain silver bromoiodide emulsions as compared to central regions of the tabular grains. Solberg et al teaches iodide concentrations in the central regions of from 0 to 5 mole percent, with at least one mole percent higher iodide concentrations in the laterally surrounding annular regions up to the solubility limit of silver iodide in silver bromide, preferably up to about 20 mole percent and optimally up to about 15 mole percent. Solberg et al constitutes a preferred species of high aspect ratio tabular grain silver bromoiodide emulsions and is here incorporated by reference. In a variant form it is specifically contemplated to terminate iodide or bromide and iodide salt addition to the reaction vessel prior to the termination of silver salt addition so that excess halide reacts with the silver salt. This results in a shell of silver bromide being formed on the tabular silver bromoiodide grains. Thus, it is apparent that the tabular silver bromoiodide grains can exhibit substantially uniform or graded iodide concentration profiles and that the gradation can be controlled, as desired, to favor higher iodide concentrations internally or at or near the surfaces of the tabular silver bromoiodide grains.

Although the preparation of the high aspect ratio tabular grain silver bromoiodide emulsions has been described by reference to the process of Wilgus and Haefner, which produces neutral or nonammoniacal emulsions, these emulsions and their utility are not limited by any particular process for their preparation. A process of preparing high aspect ratio tabular grain silver bromoiodide emulsions discovered subsequent to that of Wilgus and Haefner is described by Daubendiek and Strong U.S. Ser. No. 429,587, filed Sept. 30, 1982, commonly assigned, titled METHOD OF PREPARING HIGH ASPECT RATIO GRAINS, the Daubendiek and Strong patent application being here incorporated by reference. Daubendiek and Strong teaches an improvement over the processes of Maternaghan, U.S. Pat. Nos. 4,150,994, 4,184,877, and 4,184,878, wherein in a preferred form the silver iodide concentration in the reaction vessel is reduced below 0.05 mole per liter and the maximum size of the silver iodide grains initially present in the reaction vessel is reduced below 0.05 micron.

High aspect ratio tabular grain silver bromide emulsions lacking iodide are also useful in the multicolor photographic elements of this invention and can be prepared by the process described by Wilgus and Haefner modified to exclude iodide. High aspect ratio tabular grain silver bromide emulsions can alternatively be prepared following a procedure similar to that employed by deCugnac and Chateau, "Evolution of the Morphology of Silver Bromide Crystals During Physical Ripening", *Science et Industries Photographiques*, Vol. 33, No. 2 (1962), pp. 121-125, here incorporated by reference. High aspect ratio silver bromide emulsions containing square and rectangular grains can be prepared as taught by Mignot U.S. Pat. No. 4,386,156. In this process cubic seed grains having an edge length of less than 0.15 micron are employed. While maintaining the pAg of the seed grain emulsion in the range of from 5.0 to 8.0, the emulsion is ripened in the substantial absence of nonhalide silver ion complexing agents to produce tabular silver bromide grains having an average aspect ratio of at least 8.5:1. Still other preparations of high aspect ratio tabular grain silver bromide emulsions lacking iodide are illustrated in the examples.

To illustrate the diversity of high aspect ratio tabular grain silver halide emulsions which can be employed in addition to the high aspect ratio tabular grain silver iodide emulsions in the multicolor photographic elements of this invention, attention is directed to Wey U.S. Ser. No. 429,403, filed Sept. 30, 1982, commonly assigned, titled IMPROVED DOUBLE-JET PRECIPITATION PROCESSES AND PRODUCTS THEREOF, here incorporated by reference, which discloses a process of preparing tabular silver chloride grains which are substantially internally free of both silver bromide and silver iodide. Wey employs a double-jet precipitation process wherein chloride and silver salts are concurrently introduced into a reaction vessel containing dispersing medium in the presence of ammonia. During chloride salt introduction the pAg within the dispersing medium is in the range of from 6.5 to 10 and the pH in the range of from 8 to 10. The presence of ammonia at higher temperatures tends to cause thick grains to form, therefore precipitation temperatures are limited to up to 60° C. The process can be optimized to produce high aspect ratio tabular grain silver chloride emulsions.

Maskasky U.S. Ser. No. 431,455, filed Sept. 30, 1982, commonly assigned, titled SILVER CHLORIDE EMULSIONS OF MODIFIED CRYSTAL HABIT AND PROCESSES FOR THEIR PREPARATION, here incorporated by reference, discloses a process of preparing tabular grains of at least 50 mole percent chloride having opposed crystal faces lying in {111 }crystal planes and, in one preferred form, at least one peripheral edge lying parallel to a <211>crystallographic vector in the plane of one of the major surfaces. Such tabular grain emulsions can be prepared by reacting aqueous silver and chloridecontaining halide salt solutions in the presence of a crystal habit modifying amount of an amino-substituted azaindene and a peptizer having a thioether linkage.

Wey and Wilgus U.S. Ser. No. 431,854, filed Sept. 30, 1982, commonly assigned, titled NOVEL SILVER CHLOROBROMIDE EMULSIONS AND PROCESSES FOR THEIR PREPARATION, here incorporated by reference, discloses tabular grain emulsions wherein the silver halide grains contain chloride and bromide in at least annular grain regions and preferably throughout. The tabular grain regions containing silver, chloride, and bromide are formed by maintaining a molar ratio of chloride and bromide ions of from 1.6:1 to about 260:1 and the total concentration of halide ions in the reaction vessel in the range of from 0.10 to 0.90 normal during introduction of silver, chloride, bromide, and, optionally, iodide salts into the reaction vessel. The molar ratio of silver chloride to silver bromide in the tabular grains can range from 1:99 to 2:3.

Silver halide emulsions containing high aspect ratio silver iodide tabular grains of face centered cubic crystal structure are disclosed by Maskasky U.S. Ser. No. 451,309, cited above and here incorporated by reference. Such emulsions can be prepared by modifying conventional double-jet silver halide precipitation procedures. As noted by James, *The Theory of the Photographic Process*, cited above, precipitation on the silver side of the equivalence point (the point at which silver and iodide ion concentrations are equal) is important to achieving face centered cubic crystal structures. For example, it is preferred to precipitate at a pAg in the vicinity of 1.5, as undertaken by Daubendiek, cited above. (As employed herein pAg is the negative logarithm of silver ion concentration.) Second, in comparing the processes employed in preparing the high aspect ratio tabular grain silver iodide emulsions with the unpublished details of the process employed by Daubendiek, "AgI Precipitations: Effects of pAg on Crystal Growth (PB)", cited above, to achieve relatively low aspect ratio silver iodide grains, the flow rates for silver and iodide salt introductions in relation to the final reaction vessel volume are approximately an order of magnitude lower than those of Daubendiek (<0.003 mole/minute/liter as compared to <0.02 mole/minute/liter employed by Daubendiek).

Silver halide emulsions containing high aspect ratio silver iodide tabular grains of a hexagonal crystal structure, as exhibited by $\beta$ phase silver iodide, can be prepared by double-jet precipitation procedures on the halide side of the equivalence point. Useful parameters for precipitation are illustrated in the Examples below. Zharkov et al, cited above, discloses the preparation of silver iodide emulsions containing tabular grains of $\beta$ phase crystal structure by ripening in the presence of a ammonia and an excess of potassium iodide.

High aspect ratio tabular grain emulsions useful in the practice of this invention can have extremely high average aspect ratios. Tabular grain average aspect ratios can be increased by increasing average grain diameters. This can produce sharpness advantages, but maximum average grain diameters are generally limited by granularity requirements for a specific photographic application. Tabular grain average aspect ratios can also or alternatively be increased by decreasing average grain thicknesses. When silver coverages are held constant, decreasing the thickness of tabular grains generally improves granularity as a direct function of increasing aspect ratio. Hence the maximum average aspect ratios of the tabular grain emulsions employed in the multicolor photographic elements of this invention are a function of the maximum average grain diameters acceptable for the specific photographic application and the minimum attainable tabular grain thicknesses which can be produced. Maximum average aspect ratios have been observed to vary, depending upon the precipitation technique employed and the tabular grain halide composition. The highest observed average aspect ratios, 500:1, for tabular grains with photographically useful average grain diameters, have been achieved by Ostwald ripening preparations of silver bromide grains, with aspect ratios of 100:1, 200:1, or even higher being obtainable by double-jet precipitation procedures. The presence of iodide generally decreases the maximum average aspect ratios realized in silver bromoiodide tabular grains, but the preparation of silver bromoiodide tabular grain emulsions having average aspect ratios of 100:1 or even 200:1 or more is feasible. Average aspect ratios as high as 50:1 or even 100:1 for silver chloride tabular grains, optionally containing bromide and/or iodide, can be prepared as taught by Maskasky U.S. Ser. No. 431,455, cited above. Because of the exceptionally thin silver iodide tabular grains which can be obtained, high average aspect ratios ranging up to 100:1 can be readily achieved, regardless of whether the silver iodide is in a face centered cubic ($\gamma$ phase) or hexagonal ($\beta$ phase) crystal structure. Emulsions containing silver iodide tabular grains of hexagonal crystal structure of even higher average aspect ratios, ranging up to 200:1, or even 500:1, are contemplated.

Modifying compounds can be present during tabular grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium, and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and *Research Disclosure*, Vol. 134, June 1975, Item 13452. *Research Disclosure* and its predecessor, *Product Licensing Index*, are publications of Kenneth Mason Publications Limited; Emsworth; Hampshire P010 7DD; United Kingdom. The tabular grain emulsions can be internally reduction sensitized during precipitation, as illustrated by Moisar et al, *Journal of Photographic Science*, Vol. 25, 1977, pp. 19-27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al U.S. Pat. No. 3,821,002, Oliver U.S. Pat. No. 3,031,304 and Claes et al, *Photographische Korresondenz, Band* 102, Number 10, 1967, p. 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. patent application No. 2,022,431A, Saito et al German OLS Nos. 2,555,364 and 2,556,885, and *Research Disclosure*, Volume 166, February 1978, Item 16662.

In forming the tabular grain emulsions a dispersing medium is initially contained in the reaction vessel. In a preferred form the dispersing medium is comprised on an aqueous peptizer suspension. Peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agaragar, arrowroot, albumin and the like as described in Yutzy et al U.S. Pat. Nos. 2,614,928 and 2,614,929, Lowe et al U.S. Pat. Nos. 2,691,582, 2,614,930, 2,614,931 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, 2,276,323, 2,281,703, 2,311,058 and 2,414,207, Lowe et al U.S. Pat. Nos, 2,484,456, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,698,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and 808,228, Wood U.K. Pat. No. 822,192 and Iguchi et al U.K. Pat. No. 1,398,055. These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

It is specifically contemplated that grain ripening can occur during the preparation of high aspect ratio tabular grain silver halide emulsions useful in the practice of the present invention, and it is preferred that grain ripening occur within the reaction vessel during at least silver bromoiodide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al, U.S. Pat. No. 2,222,264, cited above; Lowe et al U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al U.S. Pat. No. 3,737,313, here incorporated by reference, can be employed.

The high aspect ratio tabular grain emulsions are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al *Soviet Chemical Industry*, Vol. 6, No. 3, 1974, pp. 181–185; by diafiltration with a semipermeable membrane, as illustrated by *Research Disclosure*, Vol. 102, October 1972, Item 10208, Hagemaier et al *Research Disclosure*, Vol. 131, March 1975, Item 13122, Bonnet *Research Disclosure*, Vol. 135, July 1975, Item 13577, Berg et al German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure*, Vol. 101, September 1972, Item 10152. Washing is particularly advantageous in terminating ripening of the tabular grains after the completion of precipitation to avoid increasing their thickness and reducing their aspect ratio.

Once the high aspect ratio tabular grain emulsions have been formed they can be shelled to produce core-shell emulsions by procedures well known to those skilled in the art. Any photographically useful silver salt can be employed in forming shells on the high aspect ratio tabular grain emulsions prepared by the present process. Techniques for forming silver salt shells are illustrated by Berriman U.S. Pat. No. 3,367,778, Porter et al U.S. Pat. Nos. 3,206,313 and 3,317,322, and Morgan U.S. Pat. No. 3,917,485. Since conventional techniques for shelling do not favor the formation of high aspect ratio tabular grains, as shell growth proceeds the average aspect ratio of the emulsion declines. If conditions favorable for tabular grain formation are present in the reaction vessel during shell formation, shell growth can occur preferentially on the outer edges of the grains so that aspect ratio need not decline. Wey and Wilgus, cited above, specifically teach procedures for shelling tabular grains without necessarily reducing the aspect ratios of the resulting core-shell grains as compared to the tabular grains employed as core grains. Evans, Daubendiek, and Raleigh U.S. Ser. No. 431,912, filed Sept. 30, 1982, commonly assigned, titled DIRECT REVERSAL EMULSIONS AND PHOTOGRAPHIC ELEMENTS USEFUL IN IMAGE TRANSFER FILM UNITS, here incorporated by reference, specifically discloses the preparation of high aspect ratio core-shell tabular grain emulsions for use in forming direct reversal images.

Although the procedures for preparing tabular silver halide grains described above will produce high aspect ratio tabular grain emulsions in which tabular grains satisfying the thickness and diameter criteria for aspect ratio account for at least 50 percent of the total projected area of the total silver halide grain population, it is recognized that further advantages can be realized by increasing the proportion of such tabular grains present. Preferably at least 70 percent (optimally at least 90 percent) of the total projected area is provided by tabular silver halide grains meeting the thickness and diameter criteria. While minor amounts of nontabular grains are fully compatible with many photographic applications, to achieve the full advantages of tabular grains the proportion of tabular grains can be increased. Larger tabular silver halide grains can be mechanically separated from smaller, nontabular grains in a mixed population of grains using conventional separation techniques—e.g., by using a centrifuge or hydrocyclone. An illustrative teaching of hydrocyclone separation is provided by Audran et al U.S. Pat. No. 3,326,641.

To the extent that radiation-sensitive silver halide emulsions other than high aspect ratio tabular grain emulsions are employed in the multicolor photographic elements of this invention, they can be chosen from any conventional emulsion heretofore employed in multicolor photographic elements. Illustrative emulsions, their preparation and chemical sensitization are disclosed in *Research Disclosure*, Vol. 176, December 1978, Item 17643, Paragraph I, Emulsion preparation and types and Paragraph III, chemical sensitization, here incorporated by reference.

Silver iodide emulsions other than high aspect ratio tabular grain emulsions to the extent employed in various forms of the multicolor photographic elements of this invention can be precipitated by procedures generally similar to those for preparing the high aspect ratio tabular grain silver iodide emulsions, described above, but without taking the precautions indicated to produce high average aspect ratios. For example, such emulsions can be prepared by the techniques disclosed by Byerley and Hirsch, Zharkov et al, and Daubendiek, "AgI Precipitations: Effects of pAg on Crystal Growth (PB)", each cited above.

The silver iodide emulsions employed in the multicolor photographic elements of this invention can be sensitized by conventional techniques. A preferred chemical sensitization technique is to deposit a silver salt epitaxially onto the tabular silver iodide grains. The epitaxial deposition of silver chloride onto silver iodide host grains is taught by Maskasky U.S. Pat. Nos. 4,094,684 and 4,142,900, and the analogous deposition of silver bromide onto silver iodide host grains is taught by Koitabashi et al U.K. patent application 2,053,499A, each cited above and here incorporated by reference.

It is specifically preferred to employ the high aspect ratio tabular silver iodide grains as host grains for epitaxial deposition. The terms "epitaxy" and "epitaxial" are employed in their art recognized sense to indicate that the silver salt is in a crystalline form having its orientation controlled by the host tabular grains. The techniques described in Maskasky U.S. Ser. No. 431,855, cited above and here incorporated by reference, are directly applicable to epitaxial deposition on the silver iodide host grains of this invention. The silver salt epitaxy is substantially excluded in a controlled manner from at least a portion of the major crystal faces of the tabular host grains. The tabular host grains direct epitaxial deposition of silver salt to their edges and/or corners. By confining epitaxial deposition to selected sites on the tabular grains an improvement in sensitivity can be achieved as compared to allowing the silver salt to be epitaxially deposited randomly over the major faces of the tabular grains. The degree to which the silver salt is confined to selected sensitization sites, leaving at least a portion of the major crystal faces substantially free of epitaxially deposited silver salt, can be varied widely without departing from the invention. In general, larger increases in sensitivity are realized as the epitaxial coverage of the major crystal faces decreases. It is specifically contemplated to confine epitaxially deposited silver salt to less than half the area of the major crystal faces of the tabular grains, preferably less than 25 percent, and in certain forms, such as corner epitaxial silver salt deposits, optimally to less than 10 or even 5 percent of the area of the major crystal faces of the tabular grains. In some embodiments epitaxial deposition has been observed to commence on the edge surfaces of the tabular grains. Thus, where epitaxy is limited, it may be otherwise confined to selected edge sensitization sites and effectively excluded from the major crystal faces.

The epitaxially deposited silver salt can be used to provide sensitization sites on the tabular host grains. By controlling the sites of epitaxial deposition, it is possible to achieve selective site sensitization of the tabular host grains. Sensitization can be achieved at one or more ordered sites on the tabular host grains. By ordered it is meant that the sensitization sites bear a predictable, nonrandom relationship to the major crystal faces of the tabular grains and, preferably, to each other. By controlling epitaxial deposition with respect to the major crystal faces of the tabular grains it is possible to control both the number and lateral spacing of sensitization sites.

In some instances selective site sensitization can be detected when the silver iodide grains are exposed to radiation to which they are sensitive and surface latent image centers are produced at sensitization sites. If the grains bearing latent image centers are entirely developed, the location and number of the latent image centers cannot be determined. However, if development is arrested before development has spread beyond the immediate vicinity of the latent image center, and the partially developed grain is then viewed under magnification, the partial development sites are clearly visible. They correspond generally to the sites of the latent image centers which in turn generally correspond to the sites of sensitizaton.

The sensitizing silver salt that is deposited onto the host tabular grains at selected sites can be generally chosen from among any silver salt capable of being epitaxially grown on a silver halide grain and heretofore known to be useful in photography. The anion content of the silver salt and the tabular silver halide grains differ sufficiently to permit differences in the respective crystal structures to be detected. It is specifically contemplated to choose the silver salts from among those heretofore known to be useful in forming shells for core-shell silver halide emulsions. In addition to all the known photographically useful silver halides, the silver salts can include other silver salts known to be capable of precipitating onto silver halide grains, such as silver thiocyanate, silver cyanide, silver carbonate, silver ferricyanide, silver arsenate or arsenite, and silver chromate. Silver chloride is a specifically preferred sensitizer. Depending upon the silver salt chosen and the intended application, the silver salt can usefully be deposited in the presence of any of the modifying compounds described above in connection with the tabular silver halide grains. Some iodide from the host grains may enter the silver salt epitaxy. It is also contemplated that the host grains can contain anions other than iodide up to their solubility limit in silver iodide, and, as employed herein, the term "silver iodide grains" is intended to include such host grains.

Conventional chemical sensitization can be undertaken prior to controlled site epitaxial deposition of silver salt on the host tabular grain or as a following step. When silver chloride and/or silver thiocyanate is deposited, a large increase in sensitivity is realized merely by selective site deposition of the silver salt. Thus, further chemical sensitization steps of a conventional type need not be undertaken to obtain photographic speed. On the other hand, an additional increment in speed can generally be obtained when further chemical sensitization is undertaken, and it is a distinct advantage that neither elevated temperature nor extended holding times are required in finishing the emulsion. The quantity of sensitizers can be reduced, if desired, where (1) epitaxial deposition itself improves sensitivity or (2) sensitization is directed to epitaxial deposition sites. Substantially optimum sensitization of tabular silver iodide emulsions has been achieved by the epitaxial deposition of silver chloride without further chemical sensitization.

Any conventional technique for chemical sensitization following controlled site epitaxial deposition can be employed. In general chemical sensitization should be undertaken based on the composition of the silver salt deposited rather than the composition of the host tabular grains, since chemical sensitization is believed to occur primarily at the silver salt deposition sites or perhaps immediately adjacent thereto. Conventional techniques for achieving noble metal (e.g., gold) middle chalcogen (e.g., sulfur, selenium, and/or tellurium), or reduction sensitization as well as combinations thereof are disclosed in *Research Disclosure*, Item 17643, Paragraph III, cited above.

High aspect ratio tabular grain emulsions other than the silver iodide emulsions discussed above can be chemically sensitized by procedures similar to those employed in chemically sensitizing emulsions conventionally employed in multicolor photographic elements, described above. Extremely high speeds and highly improved speed-granularity relationships can be achieved when the emulsions are substantially optimally sensitized following the teachings of Kofron et al, cited above. In one preferred form chemical sensitization is undertaken after spectral sensitization. Similar results have also been achieved in some instances by introducing other adsorbable materials, such as finish modifiers, into the emulsion prior to chemical sensitization. Independent of the prior incorporation of adsorbable materials, it is preferred to employ thiocyanates during chemical sensitization in concentrations of from about $2\times10^{-3}$ to 2 mole percent, based on silver, as taught by Damschroder U.S. Pat. No. 2,462,361. Other ripening agents can be used during chemical sensitization. Still a third approach, capable of being practiced independently of, but compatible with, the two approaches described above, is to deposit silver salts epitaxially on the high aspect ratio tabular grains, as is taught by Maskasky U.S. Ser. No. 431,855, cited above and here incorporated by reference.

The silver iodide emulsions intended to record blue light exposures can, but need not, be spectrally sensitized in the blue portion of the spectrum. Silver bromide and silver bromoiodide emulsions containing nontabular grains and relatively thick tabular grains can be employed to record blue light without incorporating blue sensitizers, although their absorption efficiency is much higher when blue sensitizers are present. The silver halide emulsions, regardless of composition, intended to record minus blue light are spectrally sensitized to red or green light by the use of spectral sensitizing dyes.

The silver halide emulsions incorporated in the multicolor photographic elements of this invention can be spectrally sensitized with dyes from a variety of classes, including the polymethine dye class, which classes include the cyanines, merocyanines, complex cyanines and merocyanines (i.e., tri-, tetra-, and poly-nuclear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium, and imidazopyrazinium quaternary salts.

The merocyanine spectral sensitizing dyes include, joined by a double bond or a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired.

Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering*, Vol. 18, 1974, pp. 418-430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al U.S. Pat. No. 2,131,038 and Shiba et al U.S. Pat. No. 3,930,860.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering*, Vol. 18, 1974, pp. 49-53 (Sturmer et al), pp. 175-178 (Leubner) and pp. 475-485 (Gilman). Oxidation and reduction potentials can be measured as described by R. F. Large in *Photographic Sensitivity*, Academic Press, 1973, Chapter 15.

The chemistry of cyanine and related dyes is illustrated by Weissberger and Taylor, *Special Topics of Heterocyclic Chemistry*, John Wiley and Sons, New York, 1977, Chapter VIII; Venkataraman, *The Chemistry of Synthetic Dyes*, Academic Press, New York, 1971, Chapter V; James, *The Theory of the Photographic Process*, 4th Ed., Macmillan, 1977, Chapter 8, and F. M. Hamer, *Cyanine Dyes and Related Compounds*, John Wiley and Sons, 1964.

Among useful spectral sensitizing dyes for sensitizing silver halide emulsions are those found in U.K. Pat. No. 742,112, Brooker U.S. Pat. Nos. 1,846,300, 1,846,301, 1,846,302, 1,846,303, 1,846,304, 2,078,233 and 2,089,729, Brooker et al U.S. Pat. Nos. 2,165,338, 2,213,238, 2,231,658, 2,493,747, 2,493,748, 2,526,632, 2,739,964 (Reissue 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. No. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and non-light absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,390; sulfonated aromatic compounds, as taught by Jones et al U.S. Pat. No. 2,937,089; mercapto-substituted heterocycles, as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the high aspect ratio tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.*, Vol 56, p. 1065, 1952; Spence et al, "Desensitization of Sensitizing Dyes", *Journal of Physical and Colloid Chemistry*, Vol. 56, No. 6, June 1948, pp. 1090-1103; and Gilman et al U.S. Pat. No. 3,979,213. Optimum dye concentration levels can be chosen by procedures taught by Mees, *Theory of the Photographic Process*, Macmillan, 1942, pp. 1067-1069, cited above.

Although native blue sensitivity of silver bromide or bromoiodide is usually relied upon in the art in emulsion layers intended to record exposure to blue light, it is specifically recognized that advantages can be realized from the use of blue spectral sensitizing dyes. When the blue recording emulsions in such emulsion layers are high aspect ratio tabular grain silver bromide and silver bromoiodide emulsions, very large increases in speed are realized by the use of blue spectral sensitizing dyes.

Useful blue spectral sensitizing dyes for high aspect ratio tabular grain silver bromide and silver bromoiodide emulsions can be selected from any of the dye classes known to yield spectral sensitizers. Polymethine dyes, such as cyanines, merocyanines, hemicyanines, hemioxonols, and merostyryls, are preferred blue spectral sensitizers. Generally useful blue spectral sensitizers can be selected from among these dye classes by their absorption characteristics—i.e., hue. There are, however, general structural correlations that can serve as a guide in selecting useful blue sensitizers. Generally the shorter the methine chain, the shorter the wavelength of the sensitizing maximum. Nuclei also influence absorption. The addition of fused rings to nuclei tends to favor longer wavelengths of absorption. Substituents can also alter absorption characteristics. In the formulae which follow, unless othewise specified, alkyl groups and moieties contain from 1 to 20 carbon atoms, preferably from 1 to 8 carbon atoms. Aryl groups and moieties contain from 6 to 15 carbon atoms and are preferably phenyl or naphthyl groups or moieties.

Preferred cyanine blue spectral sensitizers are monomethine cyanines; however, useful cyanine blue spectral sensitizers can be selected from among those of Formula 1.

Formula 1

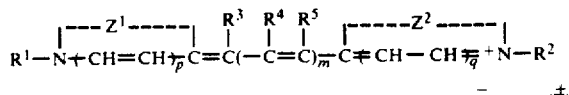

where $Z^1$ and $Z^2$ may be the same or different and each represents the elements needed to complete a cyclic nucleus derived from basic heterocyclic nitrogen compounds such as oxazoline, oxazole, benzoxazole, the naphthoxazoles (e.g., naphth[2,1-d]oxazole, naphth[2,3-d]oxazole, and naphth[1,2-d]oxazole), thiazoline, thiazole, benzothiazole, the naphthothiazoles (e.g., naphtho[2,1-d]thiazole), the thiazoloquinolines (e.g., thiazolo-[4,5-b]quinoline), selenazoline, selenazole, benzoselenazole, the naphthoselenazoles (e.g., naphtho[1,2-d]selenazole), 3H-indole (e.g., 3,3-dimethyl-3H-indole), the benzindoles (e.g., 1,1-dimethylbenz[e]indole), imidazoline, imidazole, benzimidazole, the naphthimidazoles (e.g., naphth[2,3-d]imidazole), pyridine, and quinoline, which nuclei may be substituted on the ring by one or more of a wide variety of substituents such as hydroxy, the halogens (e.g., fluoro, chloro, bromo, and iodo), alkyl groups or substituted alkyl groups (e.g., methyl, ethyl, propyl, isopropyl, butyl, octyl, dodecyl, octadecyl, 2-hydroxyethyl, 3-sulfopropyl, carboxymethyl, 2-cyanoethyl, and trifluoromethyl), aryl groups or substituted aryl groups (e.g., phenyl, 1-naphthyl, 2-naphthyl, 4-sulfophenyl, 3-carboxyphenyl, and 4-biphenyl), aralkyl groups (e.g., benzyl and phenethyl), alkoxy groups (e.g., methoxy, ethoxy, and isopropoxy), aryloxy groups (e.g., phenoxy and 1-naphthoxy), alkylthio groups (e.g., methylthio and ethylthio), arylthio groups (e.g., phenylthio, p-tolythio, and 2-naphthylthio), methylenedioxy, cyano, 2-thienyl, styryl, amino or substituted amino groups (e.g., anilino, dimethylamino, diethylamino, and morpholino), acyl groups, such as carboxy (e.g., acetyl and benzoyl) and sulfo;

$R^1$ and $R^2$ can be the same or different and represent alkyl groups, aryl groups, alkenyl groups, or aralkyl groups, with or without substituents, (e.g., carboxymethyl, 2-hydroxyethyl, 3-sulfopropyl, 3-sulfobutyl, 4-sulfobutyl, 4-sulfophenyl, 2-methoxyethyl, 2-sulfatoethyl, 3-thiosulfatopropyl, 2-phosphonoethyl, chlorophenyl, and bromophenyl);

$R^3$ represents hydrogen;

$R^4$ and $R^5$ represents hydrogen or alkyl of 5 from 1 to 4 carbon atoms;

p and q are 0 or 1, except that both p and q preferably are not 1;

m is 0 or 1 except that when m is 1 both p and q are 0 and at least one of $Z^1$ and $Z^2$ represents imidazoline, oxazoline, thiazoline, or selenazoline;

A is an anionic group;

B is a cationic group; and k and l may be 0 or 1, depending on whether ionic substituents are present. Variants are, of course, possible in which $R^1$ and $R^3$, $R^2$ and $R^5$, or $R^1$ and $R^2$ (particularly when m, p, and q are 0) together represent the atoms necessary to complete an alkylene bridge.

Some representative cyanine dyes useful as blue sensitizers are listed in Table I.

TABLE I 1. 3,3'-Diethylthiacyanine bromide

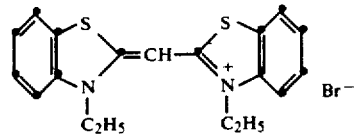

2. 1-Ethyl-3'-methyl-4'-phenylnaphthol[1,2-d]thiazolothiazolinocyanine bromide

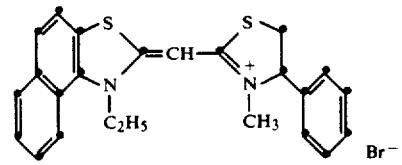

3. 1',3-Diethyl-4-phenyloxazolo-2'-cyanine iodide

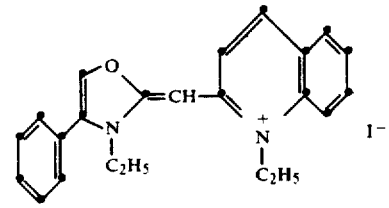

4. Anhydro 5-chloro-5'-methoxy-3,3'-bis-(2-sulfoethyl)thiacyanine hydroxide, triethylamine salt

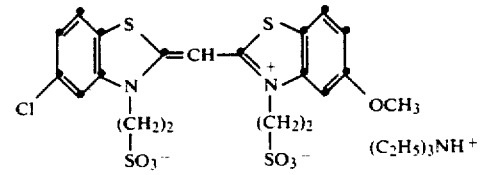

5. 3,3'-Bis(2-carboxyethyl)thiazolinocarbocyanine iodide

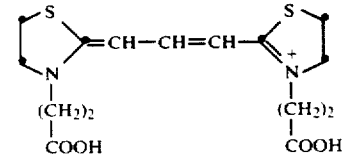

6. 1,1'-Diethyl-3,3'-ethylenebenzimidazolocyanine iodide

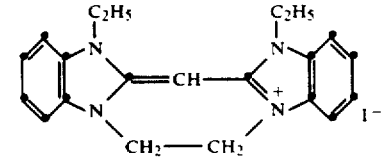

7. 1-(3-Ethyl-2-benzothiazolinylidene)-1,2,3,4-tetrahydro-2-methylpyrido-[2,1-b]-benzothiazolinium iodide TABLE I-continued

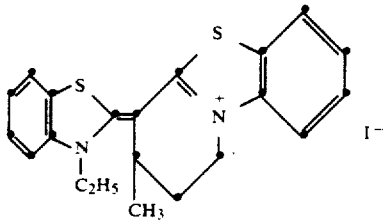

8. Anhydro-5,5'-dimethoxy-3,3'-bis(3-sulfopropyl)thiacyanine hydroxide, sodium salt

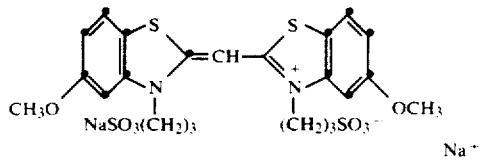

Preferred merocyanine blue spectral sensitizers are zero methine merocyanines; however, useful merocyanine blue spectral sensitizers can be selected from among those of Formula 2.

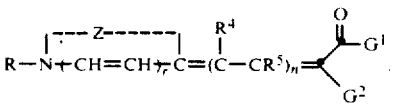

Formula 2 where

Z represents the same elements as either $Z^1$ or $Z^2$ of Formula 1 above;

R represents the same groups as either $R^1$ or $R^2$ of Formula 1 above;

$R^4$ and $R^5$ represent hydrogen, an alkyl group of 1 to 4 carbon atoms, or an aryl group (e.g., phenyl or naphthyl);

$G^1$ represents an alkyl group or substituted alkyl group, an aryl or substituted aryl group, an aralkyl group, an alkoxy group, an aryloxy group, a hydroxy group, an amino group, a substituted amino group wherein specific groups are of the types in Formula 1;

$G^2$ can represent any one of the groups listed for $G^1$ and in addition can represent a cyano group, an alkyl, or arylsulfonyl group, or a group represented by

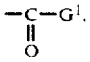

or $G^2$ taken together with $G^1$ can represent the elements needed to complete a cyclic acidic nucleus such as those derived from 2,4-oxazolidinone (e.g., 3-ethyl-2,4-oxazolidindione), 2,4-thiazolidindione (e.g., 3-methyl-2,4-thiazolidindione), 2-thio-2,4-oxazolidindione (e.g., 3-phenyl-2-thio-2,4-oxazolidindione), rhodanine, such as 3-ethylrhodanine, 3-phenylrhodanine, 3-(3-dimethylaminopropyl)rhodanine, and 3-carboxymethylrhodanine, hydantoin (e.g., 1,3-diethylhydantoin and 3-ethyl-1-phenylhydantoin), 2-thiohydantoin (e.g., 1-ethyl-3-phenyl-2-thiohydantoin, 3-heptyl-1-phenyl-2-thiohydantoin, and 1,3-diphenyl-2-thiohydantoin), 2-pyrazolin-5-one, such as 3-methyl-1-phenyl-2-pyrazolin-5-one, 3-methyl-1-(4-carboxybutyl-2-pyrazolin-5one, and 3-methyl-2-(4-sulfophenyl)-2-pyrazolin-5-one, 2-isoxazolin-5-one (e.g., 3-phenyl-2-isoxazolin-5-one), 3,5-pyrazolidindione (e.g., 1,2-diethyl-3,5-pyrazolidindione and 1,2-diphenyl-3,5-pyrazolidindione), 1,3-indandione, 1,3-dioxane-4,6-dione, 1,3-cyclohexanedione, barbituric acid (e.g., 1-ethylbarbituric acid and 1,3-diethylbarbituric acid), and 2-thiobarbituric acid (e.g., 1,3-diethyl-2-thiobarbituric acid and 1,3-bis(2-methoxyethyl)-2-thiobarbituric acid);

r and n each can be 0 or 1 except that when n is 1 then generally either Z is restricted to imidazoline, oxazoline, selenazoline, thiazoline, imidazoline, oxazole, or benzoxazole, or $G^1$ and $g^2$ do not represent a cyclic system. Some representative blue sensitizing merocyanine dyes are listed below in Table II.

TABLE II 1. 5-(3-Ethyl-2-benzoxazolinylidene)-3-phenylrhodanine

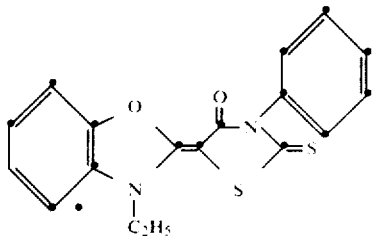

2. 5-[1-(2-Carboxyethyl)-1,4-dihydro-4-pyridinylidene]-1-ethyl-3-phenyl-2-thiohydantoin

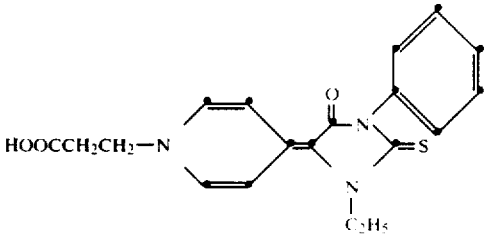

3. 4-(3-Ethyl-2-benzothiazolinylidene)-3-methyl-1-(4-sulfophenyl)-2-pyrazolin-5-one, Potassium salt

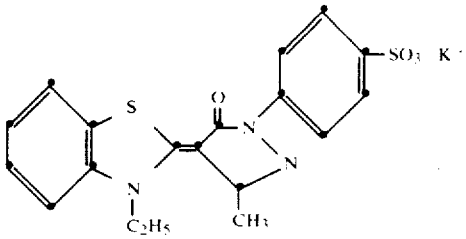

4. 3-Carboxymethyl-5-(5-chloro-3-ethyl-2-benzothiazolinylidene)rhodanine

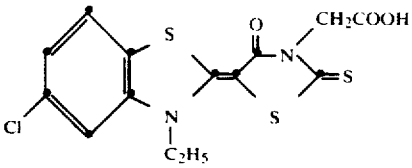

5. 1,3-Diethyl-5-[3,4,4-trimethyloxazolidinylidene)ethylidene]-2-thiobarbituric acid TABLE II-continued

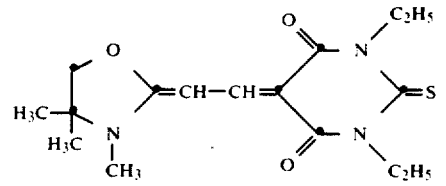

Useful blue sensitizing hemicyanine dyes include those represented by Formula 3.

Formula 3

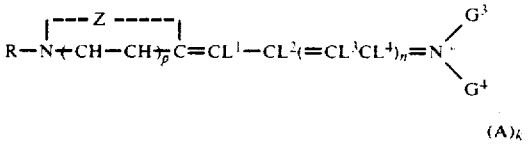

where

Z, R, and p represent the same elements as in Formula 2; $G^3$ and $G^4$ may be the same or different and may represent alkyl, substituted alkyl, aryl, substituted aryl, or aralkyl, as illustrated for ring substituents in Formula 1 or $G^3$ and $G^4$ taken together complete a ring system derived from a cyclic secondary amine, such as pyrrolidine, 3-pyrroline, piperidine, piperazine (e.g., 4-methylpiperazine and 4-phenylpiperazine), morpholine, 1,2,3,4,-tetrahydroquinoline, decahydroquinoline, 3-azabicyclo[3,2,2]nonane, indoline, azetidine, and hexahydroazepine;

$L^1$ to $L^4$ represent hydrogen, alkyl of 1 to 4 carbons, aryl, substituted aryl, or any two of $L^1$, $L^2$, $L^3$, $L^4$ can represent the elements needed to complete an alkylene or carbocyclic bridge;

n is 0 or 1; and

A and k have the same definition as in Formula 1.

Some representative blue sensitizing hemicyanine dyes are listed below in Table III.

TABLE III 1. 5,6-Dichloro-2-[4-(diethylamino)-1,3-butadien-1-yl]-1,3-diethylbenzimidazolium iodide

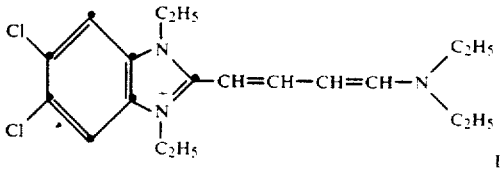

I 2. 2-{2-[2-(3-Pyrrolino)-1-cyclopenten-1-yl]ethenyl}3-ethylthaizolinium perchlorate

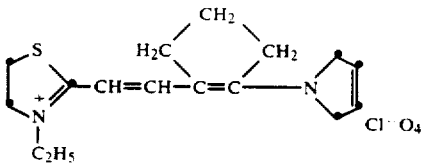

3. 2-(5,5-Dimethyl-3-piperidino-2-cyclohexen-1-yldenemethyl)-3-ethylbenzoxazolium perchlorate TABLE III-continued

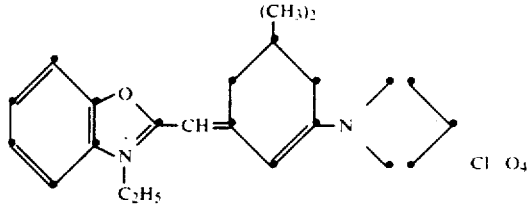

Useful blue sensitizing hemioxonol dyes include those represented by Formula 4.

Formula 4

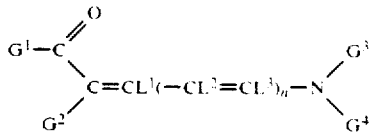

where $G^1$ and $G^2$ represent the same elements as in Formula 2;

$G^3$, $G^4$, $L^1$, $L^2$, and $L^3$ represent the same elements as in Formula 3; and n is 0 or 1.

Some representative blue sensitizing hemioxonol dyes are listed in Table IV.

TABLE IV 1. 5-(3-Anilino-2-propen-1-ylidene)-1,3-diethyl-2-thiobarbituric acid

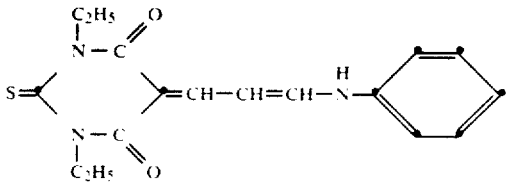

2. 3-Ethyl-5-(3-piperidino-2-propen-1-ylidene)rhodanine

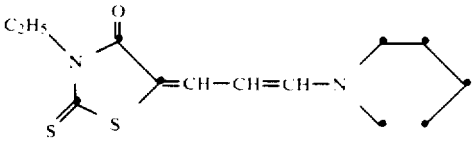

3. 3-Allyl-5-[5,5-dimethyl-3-(3-pyrrolino)-2-cyclohexen-1-ylidene]rhodanine

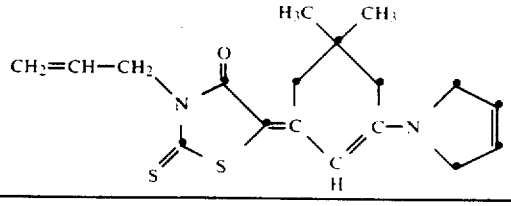

Useful blue sensitizing merostyryl dyes include those represented by Formula 5.

Formula 5

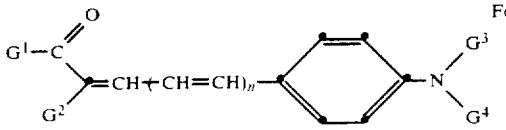

where $G^1$, $G^2$, $G^3$, $G^4$ and n are as defined in Formula 4.

Some representative blue sensitizing merostyryl dyes are listed in Table V.

TABLE V 1. 1-Cyano-1-(4-dimethylaminobenzylidene)-2-pentanone

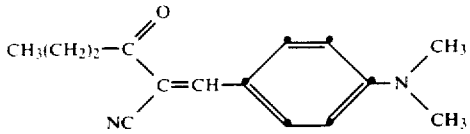

2. 5-(4-Dimethylaminobenzylidene-2,3-diphenylthiazolidin-4-one-1-oxide

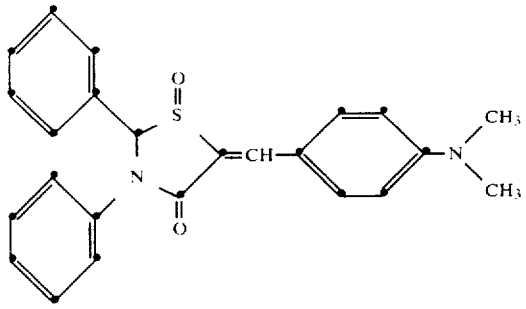

3. 2-(4-Dimethylaminocinnamylidene)thiazolo-[3,2-a]benzimidazol-3-one

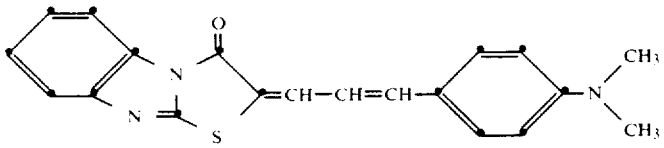

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by Philippaerts et al U.S. Pat. No. 3,628,960, and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added to the emulsion after 80 percent of the silver halide has been precipitated. Sensitization can be enhanced by pAg adjustment, including variation in pAg which completes one or more cycles, during chemical and/or spectral sensitization. A specific example of pAg adjustment is provided by *Research Disclosure*, Vol. 181, May 1979, Item 18155.

MULTICOLOR PHOTOGRAPHIC ELEMENT AND PROCESSING FEATURES

In addition to the radiation-sensitive emulsions described above the multicolor photographic elements of this invention can include a variety of features which are conventional in multicolor photographic elements and therefore require no detailed description. For example, the multicolor photographic elements of this invention can employ conventional features, such as disclosed in *Research Disclosure*, Item 17643, cited above and here incorporated by reference. Optical brighteners can be introduced, as disclosed by Paragraph V. Antifoggants and sensitizers can be incorporated, as disclosed by Paragraph VI. Absorbing and scattering materials can be employed in the emulsions of the invention and in separate layers of the photographic elements, as described in Paragraph VIII. Hardeners can be incorporated, as disclosed in Paragraph X. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. Silver halide emulsion layers as well as interlayers, overcoats, and subbing layers, if any, present in the photographic elements can be coated and dried as described in Paragraph XV.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface. Typical of useful paper and polymeric film supports are those disclosed in *Research Disclosure*, Item 17643, cited above, Paragraph XVII.

The multicolor photographic elements can be used to form dye images therein through the selective destruction or formation of dyes. The photographic elements can be used to form dye images by employing developers containing dye image formers, such as color couplers, as illustrated by U.K. Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602, and Pilato U.S. Pat. No. 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al, *Die Chemie*, Vol. 57, 1944, p. 113, Mannes et al U.S. Pat. No. 2,304,940, Martinez U.S. Pat. No. 2,269,158, Jelley et al U.S. Pat. No. 2,322,027, Frolich et al U.S. Pat. No. 2,376,679, Fierke et al U.S. Pat. No. 2,801,171, Smith U.S. Pat. No. 3,748,141, Tong U.S. Pat. No. 2,772,163, Thirtle et al U.S. Pat. No. 2,835,579, Sawdey et al U.S. Pat. No. 2,533,514, Peterson U.S. Pat. No. 2,353,754, Seidel U.S. Pat. No. 3,409,435 and Chen *Research Disclosure*, Vol. 159, July 1977, Item 15930. The dye-forming couplers can be incorporated in different amounts to achieve differing photographic effects. For example, U.K. Pat. No. 923,045 and Kumai et al U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,710,803, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.K. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat No. 3,222,176 and Canadian Pat No. 726,651, Schulte et al U.K. Pat. No. 1,248,924 and Whitmore et al U.S. Pat. No. 3,227,550. Dye-forming couplers of differing reaction rates in single or separate layers can be employed to achieve desired effects for specific photographic applications.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,642,485, Verbrugghe U.K. Pat. No. 1,236,767, Fujiwhara et al U.S. Pat. No. 3,770,436 and Matsuo et al U.S. Pat. No. 3,808,945. Dye-forming couplers and nondye-forming compounds which upon coupling release a variety of photographically useful groups are described by Lau U.S. Pat. No. 4,248,962. DIR compounds which do not form dye upon reaction with oxidized color-developing agents can be employed, as illustrated by Fujiwhara et al German OLS 2,529,350 and U.S. Pat. Nos. 3,928,041, 3,958,993 and 3,961,959, Odenwalder et al German OLS 2,448,063, Tanaka et al German OLS 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129. Silver halide emulsions which are relatively light insensitive, such as Lippmann emulsions, have been utilized as interlayers and overcoat layers to prevent or control the migration of development inhibitor fragments as described in Shiba et al U.S. Pat. No. 3,892,572.

The photographic elements can incorporate colored dye-forming couplers, such as those employed to form integral masks for negative color images, as illustrated by Hanson U.S. Pat. No. 2,449,966, Glass et al U.S. Pat. No. 2,521,908, Gledhill et al U.S. Pat. No. 3,034,892, Loria U.S. Pat. No. 3,476,563, Lestina U.S. Pat. No. 3,519,429, Friedman U.S. Pat. No. 2,543,691, Puschel et al U.S. Pat. No. 3,028,238, Menzel et al U.S. Pat. No. 3,061,432 and Greenhalgh U.K. Pat. No. 1,035,959, and/or competing couplers, as illustrated by Murin et al U.S. Pat. No. 3,876,428, Sakamoto et al U.S. Pat. No. 3,580,722, Puschel U.S. Pat. No. 2,998,314, Whitmore U.S. Pat. No. 2,808,329, Salminen U.S. Pat. No. 2,742,832 and Weller et al U.S. Pat. No. 2,689,793.

The photographic elements can include image dye stabilizers. Such image dye stabilizers are illustrated by U.K. Pat. No. 1,326,889, Lestina et al U.S. Pat. Nos. 3,432,300 and 3,698,909, Stern et al U.S. Pat. No. 3,574,627, Brannock et al U.S. Pat. No. 3,573,050, Arai et al U.S. Pat. No. 3,764,337 and Smith et al U.S. Pat. No. 4,042,394.

Dye images can be formed or amplified by processes which employ in combination with a dye-image-generating reducing agent an inert transition metal ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent, as illustrated by Matejec U.S. Pat. No. 3,674,490, *Research Disclosure*, Vol. 116, December 1973, Item 11660, and Bissonette *Research Disclosure*, Vol. 148, August 1976, Items 14836, 14846 and 14847.

The photographic elements can produce dye images through the selective destruction of dyes or dye precursors, such as silver-dye-bleach processes, as illustrated by A. Meyer, *The Journal of Photographic Science*, Vol. 13, 1965, pp. 90–97. Bleachable azo, azoxy, xanthene, azine, phenylmethane, nitroso complex, indigo, quinone, nitro-substituted, phthalocyanine and formazan dyes, as illustrated by Stauner et al U.S. Pat. No. 3,754,923, Piller et al U.S. Pat. No. 3,749,576, Yoshida et al U.S. Pat. No. 3,738,839, Froelich et al U.S. Pat. No. 3,716,368, Piller U.S. Pat. No. 3,655,388, Williams et al U.S. Pat. No. 3,642,482, Gilman U.S. Pat. No. 3,567,448, Loeffel U.S. Pat. No. 3,443,953, Anderau U.S. Pat. Nos. 3,443,952 and 3,211,556, Mory et al U.S. Pat. Nos. 3,202,511 and 3,178,291 and Anderau et al U.S. Pat. Nos. 3,178,285 and 3,178,290, as well as their hydrazo, diazonium and tetrazolium precursors and leuco and shifted derivatives, as illustrated by U.K. Pat. Nos. 923,265, 999,996 and 1,042,300, Pelz et al U.S. Pat. No. 3,684,513, Watanabe et al U.S. Pat. No. 3,615,493, Wilson et al U.S. Pat. No. 3,503,741, Boes et al U.S. Pat. No. 3,340,059, Gompf et al U.S. Pat. No. 3,493,372 and Puschel et al U.S. Pat. No. 3,561,970, can be employed.

It is common practice in forming dye images in silver halide photographic elements to remove the developed silver by bleaching. Such removal can be enhanced by incorporation of a bleach accelerator or a precursor thereof in a processing solution or in a layer of the element. In some instances the amount of silver formed by development is small in relation to the amount of dye produced, particularly in dye image amplification, as described above, and silver bleaching is omitted without substantial visual effect.

The photographic elements can be processed to form dye images which correspond to or are reversals of the silver halide rendered selectively developable by imagewise exposure. Reversal dye images can be formed in photographic elements having differentially spectrally sensitized silver halide layers by black-and-white development followed by i) where the elements lack incorporated dye image formers, sequential reversal color development with developers containing dye image formers, such as color couplers, as illustrated by Mannes et al U.S. Pat. No. 2,252,718, Schwan et al U.S. Pat. No. 2,950,970 and Pilato U.S. Pat. No. 3,547,650; ii) where the elements contain incorporated dye image formers, such as color couplers, a single color development step, as illustrated by the Kodak Ektachrome E4 and E6 and Agfa processes described in *British Journal of Photography Annual*, 1977, pp. 194–197, and *British Journal of Photography*, August 2, 1974, pp. 668–669; and iii) where the photographic elements contain bleachable dyes, silver-dye-bleach processing, as illustrated by the Cibachrome P-10 and P-18 processes described in the *British Journal of Photography Annual*, 1977, pp. 209–212.

The photographic elements can be adapted for direct color reversal processing (i.e., production of reversal color images without prior black-and-white development), as illustrated by U.K. Pat. No. 1,075,385, Barr U.S. Pat. No. 3,243,294, Hendess et al U.S. Pat. No. 3,647,452, Puschel et al German Pat. No. 1,257,570 and U.S. Pat. Nos. 3,457,077 and 3,467,520, Accary-Venet et al U.K. Pat. No. 1,132,736, Schranz et al German Pat. No. 1,259,700, Marx et al German Pat. No. 1,259,701 and Muller-Bore German OLS 2,005,091.

Dye images which correspond to the silver halide rendered selectively developable by imagewise exposure, typically negative dye images, can be produced by processing, as illustrated by the Kodacolor C-22, the Kodak Flexicolor C-41 and the Agfacolor processes described in *British Journal of Photography Annual*, 1977, pp. 201–205. The photographic elements can also be processed by the Kodak Ektaprint-3 and -300 processes as described in Kodak Color Dataguide, 5th Ed., 1975, pp. 18–19, and the Agfa color process as described in *British Journal of Photography Annual*, 1977, pp. 205–206, such processes being particularly suited to processing color print materials, such as resin-coated photographic papers, to form positive dye images.

The multicolor photographic elements of this invention produce multicolor images from combinations of subtractive primary imaging dyes. Such photographic elements are comprised of a support and typically at least a triad of superimposed silver halide emulsion layers for separately recording blue, green, and red exposures as yellow, magenta, and cyan dye images, respectively. (Exposures can be of any conventional nature and are illustrated by *Research Disclosure*, 17643, cited above, Paragraph XVIII, here incorporated by reference.) Although the present invention generally embraces any multicolor photographic element of this type including at least one silver halide emulsion layer containing high aspect ratio silver iodide tabular grains, additional advantages can be realized when additional high aspect ratio tabular grain emulsion layers are employed.

Multicolor photographic elements are often described in terms of color-forming layer units. Most commonly multicolor photographic elements contain three superimposed color-forming layer units each containing at least one silver halide emulsion layer capable of recording exposure to a different third of the spectrum and capable of producing a complementary subtractive primary dye image. Thus, blue, green, and red recording color-forming layer units are used to produce yellow, magenta, and cyan dye images, respectively. Dye imaging materials need not be present in any color-forming layer unit, but can be entirely supplied from processing solutions. When dye imaging materials are incorporated in the photographic element, they can be located in an emulsion layer or in a layer located to receive oxidized developing or electron transfer agent from an adjacent emulsion layer of the same color-forming layer unit.

To prevent migration of oxidized developing or electron transfer agents between color-forming layer units with resultant color degradation, it is common practice to employ scavengers. The scavengers can be located in the emulsion layers themselves, as taught by Yutzy et al U.S. Pat. No. 2,937,086 and/or in interlayers between adjacent color-forming layer units, as illustrated by Weissberger et al U.S. Pat. No. 2,336,327. It is also contemplated to employ Lippmann emulsions, particularly silver chloride and silver bromide emulsions of grain diameters of less than 0.1 micron, blended with the silver iodide emulsions or in separate interlayers separating the silver iodide emulsion layers from the silver halide emulsion layers to act as scavengers for iodide ions released on development. Suitable Lippmann emulsions are disclosed by Shiba et al U.S. Pat. No. 3,892,572, cited above, and Nicholas et al U.S. Pat. No. 3,737,317, the disclosures of which are here incorporated by reference.

Although each color-forming layer unit can contain a single emulsion layer, two, three, or more emulsion layers differing in photographic speed are often incorporated in a single color-forming layer unit. Where the desired layer order arrangement does not permit multiple emulsion layers differing in speed to occur in a single color-forming layer unit, it is common practice to provide multiple (usually two or three) blue, green, and/or red recording color-forming layer units in a single photographic element.

The multicolor photographic elements of this invention can take any convenient form consistent with the requirements indicated above. Any of the six possible layer arrangements of Table 27a, p. 211, disclosed by Gorokhovskii, *Spectral Studies of the Photographic Process*, Focal Press, New York, can be employed. To provide a simple, specific illustration, it is contemplated to add to a conventional multicolor silver halide photographic element during its preparation one or more blue recording emulsion layers containing high aspect ratio tabular silver iodide grains positioned to receive exposing radiation prior to the remaining emulsion layers. However, in most instances it is preferrred to substitute one or more blue recording emulsion layers containing high aspect ratio tabular silver iodide grains for conventional blue recording emulsion layers, optionally in combination with layer order arrangement modifications.

The invention can be better appreciated by reference to the following discussion of distinctive features exhibited by the multicolor photographic elements of this invention, particularly those contributed by the presence of silver iodide and/or high average aspect ratio tabular grains.

a. Blue light absorbing capabilities

The multicolor photographic elements of this invention use at least one emulsion layer containing high aspect ratio tabular silver iodide grains to record imagewise exposures to the blue portion of the visible spectrum. Since silver iodide possesses a very high level of absorption of blue light in the spectral region of less than about 430 nanometers, in one application of this invention the silver iodide grains can be relied upon to absorb blue light of 430 nanometers or less in wavelength without the use of a blue spectral sensitizing dye. A silver iodide tabular grain is capable of absorbing most of the less than 430 nanometer blue light incident upon it when it is at least about 0.1 micron in thickness and substantially all of such light when it is at least about 0.15 micron in thickness. (In coating emulsion layers containing high aspect ratio tabular grains the grains spontaneously align themselves so that their major crystal faces are parallel to the support surface and hence perpendicular to the direction of exposing radiation. Hence exposing radiation seeks to traverse the thickness of the tabular grains.)

The blue light absorbing capability of tabular silver iodide grains is in direct contrast to the light absorbing capability of the high aspect ratio tabular grain emulsions of other silver halide compositions, such as those disclosed by Kofron et al, cited above. The latter exhibit markedly lower levels of blue light absorption even at thicknesses up to 0.3 micron. Kofron et al, for instance, specifically teaches to increase tabular grain thicknesses up to 0.5 micron to increase blue light absorption. Further, it should be noted that the tabular grain thicknesses taught by Kofron et al take into account that the emulsion layer will normally be coated with a conventional silver coverage, which is sufficient to provide many layers of superimposed tabular grains, whereas the 0.1 and 0.15 micron thicknesses above are for a single grain. It is therefore apparent that not only can tabular silver iodide grains be used without blue spectral sensitizers, but they permit blue recording emulsion layers to be reduced in thickness (thereby increasing sharpness) and reduced in silver coverage. In considering this application of the invention further it can be appreciated that tabular grain silver iodide emulsions, provided minimal grain thicknesses are satisfied, absorb blue light as a function of the projected area which they present to exposing radiation. This is a fundamental distinction over other silver halides, such as silver bromide and silver bromoiodide, which, without the assistance of spectral sensitizers, absorb blue light as a function of their volume.

Not only are the high aspect ratio tabular grain silver iodide emulsions more efficient in absorbing blue light than high aspect ratio tabular grains of differing halide composition, they are more efficient than conventional silver iodide emulsions containing nontabular grains or lower average aspect ratio tabular grains. At a silver coverage chosen to employ the blue light absorbing capability of the high aspect ratio tabular silver iodide grains efficiently conventional silver iodide emulsions present lower projected areas and hence are capable of reduced blue light absorption. They also capture fewer photons per grain and are of lower photographic speed than the high aspect ratio tabular silver iodide grain emulsions, other parameters being comparable. If the average diameters of the conventional silver iodide grains are increased to match the projected areas presented by the high aspect ratio tabular grain silver iodide emulsions, the conventional grains become much thicker than the high aspect ratio tabular silver iodide grains, require higher silver coverages to achieve comparable blue absorption, and are in general less efficient.

Although high aspect ratio tabular silver iodide grain emulsions can be used to record blue light exposures without the use of spectral senstizing dyes, it is appreciated that the native blue absorption of silver iodide is not high over the entire blue region of the spectrum. To achieve a photographic response over the entire blue region of the spectrum it is specifically contemplated to employ in combination with such emulsions one or more blue sensitizing dyes. The dye preferably exhibits an absorption peak of a wavelength longer than 430 nanometers so that the absorption of the silver iodide forming the tabular grains and the blue sensitizing dye together extend over a larger wavelength range of the blue spectrum.

While silver iodide and a blue sensitizing dye can be employed in combination to provide a photographic response over the entire blue portion of the spectrum, if the silver iodide grains are chosen as described above for recording blue light efficiently in the absence of spectral sensitizing dye, the result is a highly unbalanced sensitivity. The silver iodide grains absorb substantially all of the blue light of a wavelength of less than 430 nanometers while the blue sensitizing dye absorbs only a fraction of the blue light of a wavelength longer than 430. To obtain a balanced sensitivity over the entire blue portion of the spectrum it is contemplated to reduce the efficiency of the silver iodide grains in absorbing light of less than 430 nanometers in wavelength. This can be accomplished by reducing the average thickness of the tabular grains so that they are less than 0.1 micron in thickness. The optimum thickness of the tabular grains for a specific application is selected so that absorption above and below 430 nanometers is substantially matched. This will vary as a function of the spectral sensitizing dye or dyes employed.

b. Capabilities related to epitaxy

As indicated above, there are distinct advantages to be realized by epitaxially depositing silver chloride onto the silver halide host grains. Once the silver chloride is epitaxially deposited, however, it can be altered in halide content by substituting less soluble halide ions in the silver chloride crystal lattice. Using a conventional halide conversion process bromide and/or halide ions can be introduced into the original silver chloride crystal lattice. Halide conversion can be achieved merely by bringing the emulsion comprised of silver halide host grains bearing silver chloride epitaxy into contact with an aqueous solution of bromide and/or iodide salts. An advantage is achieved in extending the halide compositions available for use while retaining the advantages of silver chloride epitaxial deposition. Additionally, the converted halide epitaxy forms an internal latent image. This permits the emulsions to be applied to photographic applications requiring the formation of an internal latent image, such as direct positive imaging. Further advantages and features of this form of the invention can be appreciated by reference to Maskasky U.S. Pat. No. 4,142,900, here incorporated by reference.

When the silver salt epitaxy is much more readily developed than the host grains, it is possible to control whether the silver salt epitaxy alone or the entire composite grain develops merely by controlling the choice of developing agents and the conditions of development. With vigorous developing agents, such as hydroquinone, catechol, halohydroquinone, N-methylaminophenol sulfate, 3-pyrazolidinone, and mixtures thereof, complete development of the composite silver halide grains can be achieved. Maskasky U.S. Pat. No. 4,094,684, cited above and here incorporated by reference, illustrates that under certain mild development conditions it is possible to selectively develop silver chloride epitaxy while not developing silver iodide host grains. Development can be specifically optimized for maximum silver development or for selective development of epitaxy, which can result in reduced graininess of the photographic image. Further, the degree of silver iodide development can control the release of iodide ions, which can be used to inhibit development.

c. Capabilities imparted by iodide ion release

In a specific application of this invention a multicolor photographic element can be constructed incorporating a uniform distribution of a redox catalyst in addition to at least one layer containing high aspect ratio tabular silver iodide grains. When the silver iodide grains are imagewise developed, iodide ion is released which locally poisons the redox catalyst. Thereafter a redox reaction can be catalyzed by the unpoisoned catalyst remaining. Bissonette U.S. Pat. No. 4,089,685, here incorporated by reference, specifically illustrates a useful redox system in which a peroxide oxidizing agent and a dye-image-generating reducing agent, such as a color developing agent or redox dye-releasor, react imagewise at available, unpoisoned catalyst sites within a photographic element. Maskasky U.S. Pat. No. 4,158,565, here incorporated by reference, discloses the use of silver iodide host grains bearing silver chloride epitaxy in such a redox amplification system.

d. Speed-granularity capabilities

An important advantage of the multicolor photographic elements of this invention is their improved speed-granularity relationship. As taught by Kofron et al, cited above, substantially optimally chemically and spectrally sensitized high aspect ratio tabular grain silver halide emulsions can exhibit unexpected improvements in the speed-granularity relationships of multicolor photographic elements.

Within the range of silver halide grain sizes normally encountered in photographic elements the maximum speed obtained at optimum sensitization increases linearly with increasing grain size. The number of absorbed quanta necessary to render a grain developable is substantially independent of grain size, but the density that a given number of grains will produce upon development is directly related to their size. If the aim is to produce a maximum density of 2, for example, fewer grains of 0.4 micron as compared to 0.2 micron in average diameter are required to produce that density. Less radiation is required to render fewer grains developable.

Unfortunately, because the density produced with the larger grains is concentrated at fewer sites, there are greater point-to-point fluctuations in density. The viewer's perception of point-to-point fluctuations in density is termed "graininess". The objective measurement of point-to-point fluctuations in density is termed "granularity". While quantitative measurements of granularity have taken different forms, granularity is most commonly measured as rms (root mean square) granularity, which is defined as the standard deviation of density within a viewing microaperture (e.g., 24 to 48 microns). Once the maximum permissible granularity (also commonly referred to as grain, but not to be confused with silver halide grains) for a specific emulsion layer is identified, the maximum speed which can be realized for that emulsion layer is also effectively limited.

From the foregoing it can be appreciated that over the years intensive investigation in the photographic art has rarely been directed toward obtaining maximum photographic speed in an absolute sense, but, rather, has been directed toward obtaining maximum speed at optimum sensitization while satisfying practical granularity or grain criteria. True improvements in silver halide emulsion sensitivity allow speed to be increased without increasing granularity, granularity to be reduced without decreasing speed, or both speed and granularity to be simultaneously improved. Such sensitivity improvement is commonly and succinctly referred to in the art as improvement in the speed-granularity relationship of an emulsion.

Figure 7:
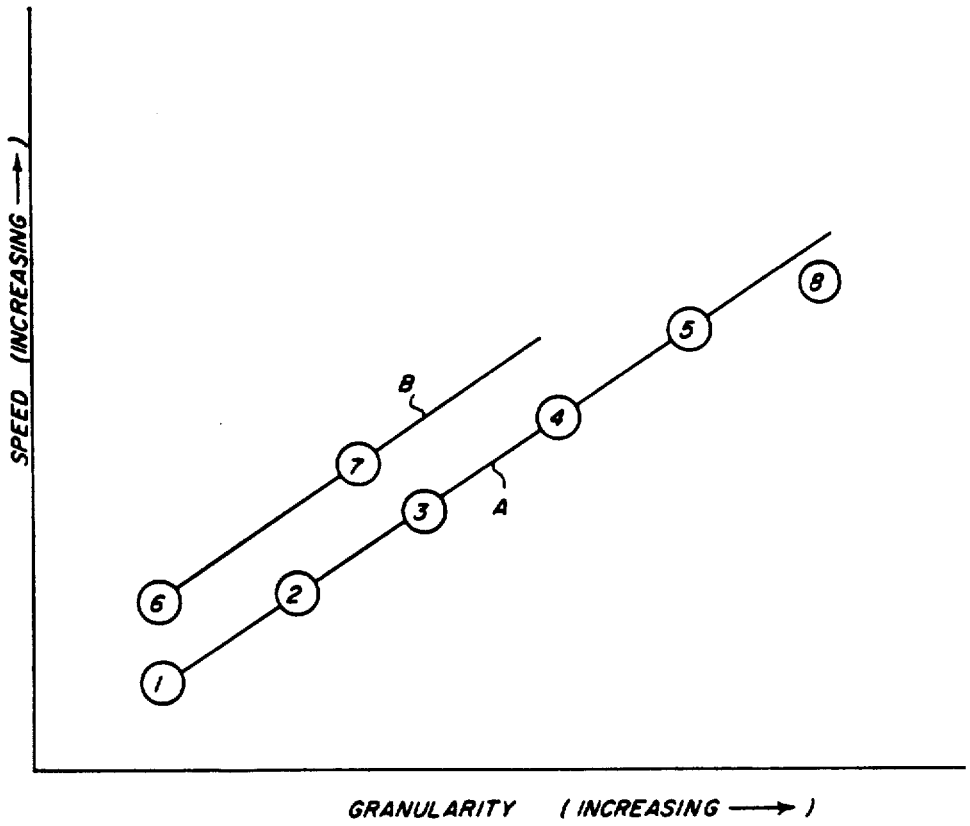
FIG. 7 is a plot of speed versus granularity.

In FIG. 7 a schematic plot of speed versus granularity is shown for five silver halide emulsions 1, 2, 3, 4, and 5 of the same composition, but differing in grain size, each similarly sensitized, identically coated, and identically processed. While the individual emulsions differ in maximum speed and granularity, there is a predictable linear relationship between the emulsions, as indicated by the speed-granularity line A. All emulsions which can be joined along the line A exhibit the same speed-granularity relationship. Emulsions which exhibit true improvements in sensitivity lie above the speed-granularity line A. For example, emulsions 6 and 7, which lie on the common speed-granularity line B, are superior in their speed-granularity relationships to any one of the emulsions 1 through 5. Emulsion 6 exhibits a higher speed than emulsion 1, but no higher granularity. Emulsion 6 exhibits the same speed as emulsion 2, but at a much lower granularity. Emulsion 7 is of higher speed than emulsion 2, but is of a lower granularity than emulsion 3, which is of lower speed than emulsion 7. Emulsion 8, which falls below the speed-granularity line A, exhibits the poorest speed-granularity relationship shown in FIG. 7. Although emulsion 8 exhibits the highest photographic speed of any of the emulsions, its speed is realized only at a disproportionate increase in granularity.

The importance of speed-granularity relationship in photography has led to extensive efforts to quantify and generalize speed-granularity determinations. It is normally a simple matter to compare precisely the speed-granularity relationships of an emulsion series differing by a single characteristic, such as silver halide grain size. The speed-granularity relationships of photographic products which produce similar characteristic curves are often compared. For elaboration of granularity measurements in dye imaging attention is directed to "Understanding Graininess and Granularity", Kodak Publication No. F-20, Revised 11-79 (available from Eastman Kodak Company, Rochester, New York 14650); Zwick, "Quantitative Studies of Factors Affecting Granularity", *Photographic Science and Engineering*, Vol. 9, No. 3, May-June, 1965; Ericson and Marchant, "RMS Granularity of Monodisperse Photographic Emulsions", *Photographic Science and Engineering*, Vol. 16, No. 4, July-August 1972, pp. 253-257; and Trabka, "A Random-Sphere Model for Dye Clouds", *Photographic Science and Engineering*, Vol. 21, No. 4, July-August 1977, pp. 183-192.

To achieve the highest attainable speed-granularity relationships in the multicolor photographic elements of this invention it is specifically preferred that the emulsions contained in the multicolor elements be substantially optimally chemically and spectrally sensitized, although, subject to the considerations discussed above, the silver iodide emulsions need not be spectrally sensitized. By "substantially optimally" it is meant that the emulsions preferably achieve speeds of at least 60 percent of the maximum log speed attainable from the grains in the spectral region of sensitization under the contemplated conditions of use and processing. Log speed is herein defined as 100(1-log E), where E is measured in meter-candle-seconds at a density of 0.1 above fog. Substantially optimum chemical and spectral sensitization of high aspect ratio tabular grain silver halide emulsions, particularly silver bromoiodide emulsions, is generally taught by Kofron et al. Such emulsions can exhibit speed-granularity relationships superior to conventional (low aspect ratio tabular grain or nontabular grain) emulsions. It is generally preferred to employ silver bromoiodide emulsions in combination with the high aspect ratio tabular grain silver iodide emulsions to achieve the highest attainable speed-granularity relationships. Illingsworth U.S. Pat. No. 3,320,069 particularly illustrates conventional silver bromoiodide emulsions of outstanding speed-granularity relationship contemplated for use in the multicolor photographic elements of this invention.

e. Sharpness capabilities

While granularity, because of its relationship to speed, is often a focal point of discussion relating to image quality, image sharpness can be addressed independently. Some factors which influence image sharpness, such as lateral diffusion of imaging materials during processing (sometimes termed "image smearing"), are more closely related to imaging and processing materials than the silver halide grains. On the other hand, because of their light scattering properties, silver halide grains themselves primarily affect sharpness during imagewise exposure. It is known in the art that silver halide grains having diameters in the range of from 0.2 to 0.6 micron exhibit maximum scattering of visible light.

Figure 8:
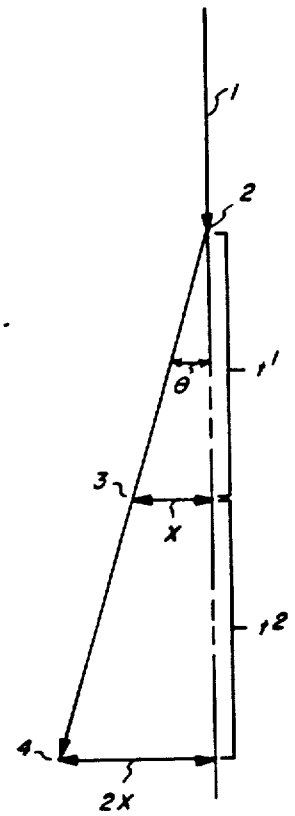
FIGS. 8 and 9 are schematic diagrams related to scattering.

Loss of image sharpness resulting from light scattering generally increases with increasing thickness of a silver halide emulsion layer. The reason for this can be appreciated by reference to FIG. 8. If a photon of light 1 is deflected by a silver halide grain at a point 2 by an angle $\theta$ measured as a declination from its original path and is thereafter absorbed by a second silver halide grain at a point 3 after traversing a thickness $t^1$ of the emulsion layer, the photographic record of the photon is displaced laterally by a distance x. If, instead of being absorbed within a thickness $t^1$, the photon traverses a second equal thickness $t^2$ and is absorbed at a point 4, the photographic record of the photon is displaced laterally by twice the distance x. It is therefore apparent that the greater the thickness displacement of the silver halide grains in a photographic element, the greater the risk of reduction in image sharpness attributable to light scattering. (Although FIG. 8 illustrates the principle in a very simple situation, it is appreciated that in actual practice a photon is typically reflected from several grains before actually being absorbed and statistical methods are required to predict its probable ultimate point of absorption.)

In multicolor photographic elements containing three or more superimposed silver halide emulsion layers an increased risk of reduction in image sharpness can be presented, since the silver halide grains are distributed over at least three layer thicknesses. In some applications thickness displacement of the silver halide grains is further increased by the presence of additional materials that either (1) increase the thicknesses of the emulsion layers themselves—as where dye-image-providing materials, for example, are incorporated in the emulsion layers or (2) form additional layers separating the silver halide emulsion layers, thereby increasing their thickness displacement—as where separate scavenger and dye-image-providing material layers separate adjacent emulsion layers. Further, in multicolor photographic elements there are at least three superimposed layer units, each containing at least one silver halide emulsion layer. Thus, there is a substantial opportunity for loss of image sharpness attributable to scattering. Because of the cumulative scattering of overlying silver halide emulsion layers, the emulsion layers farther removed from the exposing radiation source can exhibit very significant reductions in sharpness.

The high aspect ratio tabular grain silver halide emulsions employed in the multicolor photographic elements of the present invention are advantageous because of their reduced high angle light scattering as compared to nontabular and lower aspect ratio tabular grain emulsions. As discussed above with reference to FIG. 8, the art has long recognized that image sharpness decreases with increasing thickness of one or more silver halide emulsion layers. However from FIG. 8 it is also apparent that the lateral component of light scattering (x and 2x) increases directly with the angle $\theta$. To the extent that the angle $\theta$ remains small, the lateral displacement of scattered light remains small and image sharpness remains high.

Figure 9:
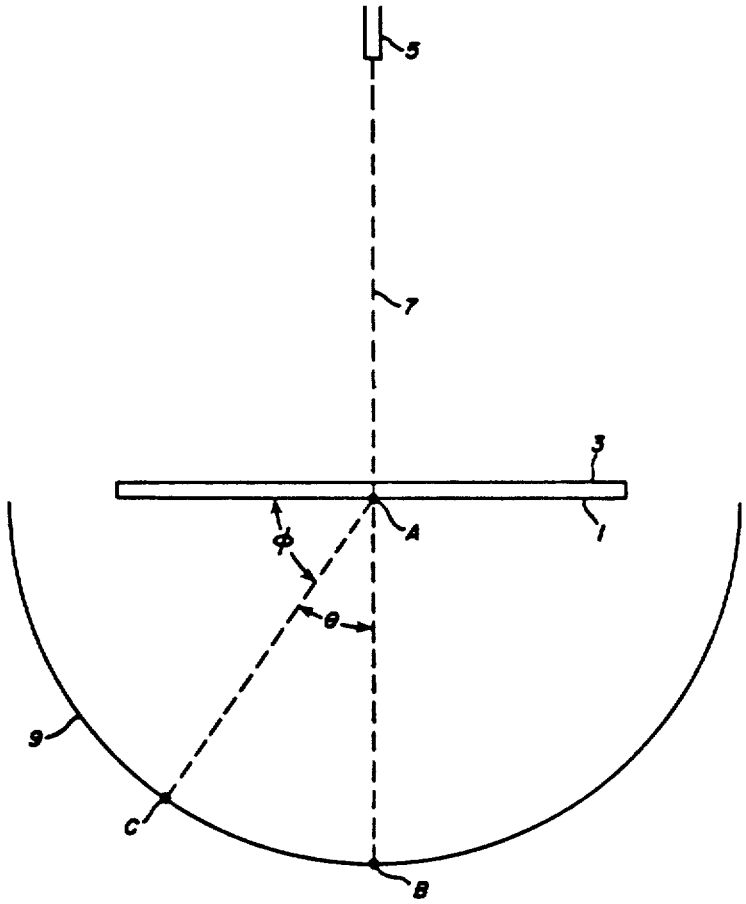

Advantageous sharpness characteristics obtainable with high aspect ratio tabular grain emulsions of the present invention are attributable to the reduction of high angle scattering. This can be quantitatively demonstrated. Referring to FIG. 9, a sample of an emulsion 1 according to the present invention is coated on a transparent (specularly transmissive) support 3 at a silver coverage of 1.08 g/m$^2$. Although not shown, the emulsion and support are preferably immersed in a liquid having a substantially matched refractive index to minimize Fresnel reflections at the surfaces of the support and the emulsion. The emulsion coating is exposed perpendicular to the support plane by a collimated light source 5. Light from the source following a path indicated by the dashed line 7, which forms an optical axis, strikes the emulsion coating at point A. Light which passes through the support and emulsion can be sensed at a constant distance from the emulsion at a hemispherical detection surface 9. At a point B, which lies at the intersection of the extension of the initial light path and the detection surface, light of a maximum intensity level is detected.

An arbitrarily selected point C is shown in FIG. 9 on the detection surface. The dashed line between A and C forms an angle $\phi$ with the emulsion coating. By moving point C on the detection surface it is possible to vary $\phi$ from 0° to 90°. By measuring the intensity of the light scattered as a function of the angle $\phi$ it is possible (because of the rotational symmetry of light scattering about the optical axis 7) to determine the cumulative light distribution as a function of the angle $\phi$. (For a background description of the cumulative light distribution see DePalma and Gasper, "Determining the Optical Properties of Photographic Emulsions by the Monte Carlo Method", *Photographic Science and Engineering*, Vol. 16, No. 3, May-June 1971, pp. 181-191.)

After determining the cumulative light distribution as a function of the angle $\phi$ at values from 0° to 90° for the emulsion 1 according to the present invention, the same procedure is repeated, but with a conventional emulsion of the same average grain volume coated at the same silver coverage on another portion of support 3. In comparing the cumulative light distribution as a function of the angle $\phi$ for the two emulsions, for values of $\phi$ up to 70° (and in some instances up to 80° and higher) the amount of scattered light is lower with the emulsions according to the present invention. In FIG. 9 the angle $\theta$ is shown as the complement of the angle $\phi$. The angle of scattering is herein discussed by reference to the angle $\theta$. Thus, the high aspect ratio tabular grain emulsions of this invention exhibit less high-angle scattering. Since it is high-angle scattering of light that contributes disproportionately to reduction in image sharpness, it follows that the high aspect ratio tabular grain emulsions of the present invention are in each instance capable of producing sharper images.

As herein defined the term "collection angle" is the value of the angle $\theta$ at which half of the light striking the detection surface lies within an area subtended by a cone formed by rotation of line AC about the polar axis at the angle $\theta$ while half of the light strikes the detection surface within the remaining area.

While not wishing to be bound by any particular theory to account for the reduced high angle scattering properties of high aspect ratio tabular grain emulsions according to the present invention, it is believed that the large flat major crystal faces presented by the high aspect ratio tabular grains as well as the orientation of the grains in the coating account for the improvements in sharpness observed. Specifically, it has been observed that the tabular grains present in a silver halide emulsion coating are substantially aligned with the planar support surface on which they lie. Thus, light directed perpendicular to the photographic element striking the emulsion layer tends to strike the tabular grains substantially perpendicular to one major crystal face. The thinness of tabular grains as well as their orientation when coated permits the high aspect ratio tabular grain emulsion layers of this invention to be substantially thinner than conventional emulsion coatings, which can also contribute to sharpness. The tabular silver iodide grains can be even thinner than tabular grains of other silver halide compositions and be coated at lower silver coverages while still exhibiting efficient blue absorption. Thus high aspect ratio tabular grain silver iodide elements often are capable of permitting significant improvements in sharpness in the multicolor elements of this invention.

In a specific preferred form of the invention the high aspect ratio tabular grain emulsion layers exhibit a minimum average grain diameter of at least 1.0 micron, most preferably at least 2 microns. Both improved speed and sharpness are attainable as average grain diameters are increased. While maximum useful average grain diameters will vary with the graininess that can be tolerated for a specific imaging application, the maximum average grain diameters of high aspect ratio tabular grain emulsions according to the present invention are in all instances less than 30 microns, preferably less than 15 microns, and optimally no greater than 10 microns.

Although it is possible to obtain reduced high angle scattering with single layer coatings of high aspect ratio tabular grain emulsions according to the present invention, it does not follow that reduced high angle scattering is necessarily realized in multicolor coatings. In certain multicolor coating formats enhanced sharpness can be achieved with the high aspect ratio tabular grain emulsions of this invention, but in other multicolor coating formats the high aspect ratio tabular grain emulsions of this invention can actually degrade the sharpness of underlying emulsion layers. If the emulsion layer of the multicolor photographic element lying nearest the exposing radiation source contains grains having an average diameter in the range of from 0.2 to 0.6 micron, as is typical of many nontabular emulsions, it will exhibit maximum scattering of light passing through it to reach the underlying emulsion layers. Unfortunately, if light has already been scattered before it reaches a high aspect ratio tabular grain emulsion layer, the tabular grains can scatter the light passing through to one or more underlying emulsion layers to an even greater degree than a conventional emulsion. Thus, this particular choice of emulsions and layer arrangement results in the sharpness of the emulsion layer or layers underlying the high aspect ratio tabular grain emulsion layer being significantly degraded to an extent greater than would be the case if no high aspect ratio tabular grain emulsions were present in the layer order arrangement.

In order to realize fully the sharpness advantages in an emulsion layer that underlies a high aspect ratio tabular grain emulsion layer it is preferred that the the tabular grain emulsion layer be positioned to receive light that is free of significant scattering (preferably positioned to receive substantially specularly transmitted light). Stated another way, in the multicolor photographic elements of this invention improvements in sharpness in emulsion layers underlying tabular grain emulsion layers are best realized only when the tabular grain emulsion layer does not itself underlie a turbid layer. For example, if a high aspect ratio tabular grain green recording emulsion layer overlies a red recording emulsion layer and underlies a Lippmann emulsion layer and/or a high aspect ratio tabular grain blue recording emulsion layer according to this invention, the sharpness of the red recording emulsion layer will be improved by the presence of the overlying tabular grain emulsion layer or layers. Stated in quantitative terms, if the collection angle of the layer or layers overlying the high aspect ratio tabular grain green recording emulsion layer is less than about 10°, an improvement in the sharpness of the red recording emulsion layer can be realized. It is, of course, immaterial whether the red recording emulsion layer is itself a high aspect ratio tabular grain emulsion layer insofar as the effect of the overlying layers on its sharpness is concerned.

In a multicolor photographic element containing superimposed color-forming units it is preferred that at least the emulsion layer lying nearest the source of exposing radiation be a high aspect ratio tabular grain emulsion in order to obtain the advantages of sharpness offerred by this invention. In a specifically preferred form of the invention each emulsion layer which lies nearer the exposing radiation source than another image recording emulsion layer is a high aspect ratio tabular grain emulsion layer.

f. Blue and minus-blue speed separation

Silver bromide and silver bromoiodide emulsions possess sufficient native sensitivity to the blue portion of the spectrum to record blue radiation without blue spectral sensitization. When these emulsions are employed to record green and/or red (minus blue) light exposures, they are correspondingly spectrally sensitized. In multicolor photography, the native sensitivity of silver bromide and silver bromoiodide in emulsions intended to record blue light is advantageous. However, when these silver halides are employed in emulsion layers intended to record exposures in the green or red portion of the spectrum, the native blue sensitivity is an inconvenience, since response to both blue and green light or both blue and red light in the emulsion layers will falsify the hue of the multicolor image sought to be reproduced.

In constructing multicolor photographic elements using silver bromide or silver bromoiodide emulsions the color falsification can be analyzed as two distinct concerns. The first concern is the difference between the blue speed of the green or red recording emulsion layer and its green or red speed. The second concern is the difference between the blue speed of each blue recording emulsion layer and the blue speed of the corresponding green or red recording emulsion layer. Generally in preparing a multicolor photographic element intended to record accurately image colors under daylight exposure conditions (e.g., 5500° K.) the aim is to achieve a difference of about an order of magnitude between the blue speed of each blue recording emulsion layer and the blue speed of the corresponding green or red recording emulsion layer. The art has recognized that such aim speed differences are not realized using silver bromide or silver bromoiodide emulsions unless employed in combination with one or more approaches known to ameliorate color falsification. Even then, full order of magnitude speed differences have not always been realized in product. However, even when such aim speed differences are realized, further increasing the separation between blue and minus blue speeds will further reduce the recording of blue exposures by layers intended to record minus blue exposures.

By far the most common approach to reducing exposure of red and green spectrally sensitized silver bromide and silver bromoiodide emulsion layers to blue light, thereby effectively reducing their blue speed, is to locate these emulsion layers behind a yellow (blue absorbing) filter layer. Both yellow filter dyes and yellow colloidal silver are commonly employed for this purpose. In a common multicolor layer format all of the emulsion layers are silver bromide or bromoiodide. The emulsion layers intended to record green and red exposures are located behind a yellow filter while the emulsion layer or layers intended to record blue light are located in front of the filter layer. (For specific examples refer to U.S. Patent and Trademark Office Class 430, PHOTOGRAPHIC CHEMISTRY, subclass 507.)

This arrangement has a number of art-recognized disadvantages. While blue light exposure of green and red recording emulsion layers is reduced to tolerable levels, a less than ideal layer order arrangement is imposed by the use of a yellow filter. The green and red emulsion layers receive light that has already passed through both the blue emulsion layer or layers and the yellow filter. This light has been scattered to some extent, and image sharpness can therefore be degraded. Further, the yellow filter is itself imperfect and actually absorbs to a slight extent in the green portion of the spectrum, which results in a loss of green speed. The yellow filter material, particularly where it is yellow colloidal silver, increases materials cost and accelerates required replacement of processing solutions, such as bleaching and bleach-fixing solutions.

Still another disadvantage associated with separating the blue emulsion layer or layers of a Photographic element from the red and green emulsion layers by interposing a yellow filter is that the speed of the blue emulsion layer is decreased. This is because the yellow filter layer absorbs blue light passing through the blue emulsion layer or layers that might otherwise be reflected to enhance exposure.

A number of approaches have been suggested for avoiding the disadvantages of yellow filters in multicolor photographic elements, as illustrated by Lohmann U.K. Pat. No. 1,560,963, which teaches relocating the yellow filter layer; Gaspar U.S. Pat. No. 2,344,084, which teaches using silver chloride and silver chlorobromide emulsions; and Mannes et al. U.S. Pat. No. 2,388,859, and Knott et al U.S. Pat. No. 2,456,954, which teach introducing an order of magnitude difference between the blue and minus blue speeds of the blue and minus blue recording emulsion layers; but each has introduced other significant disadvantages. For example, Lohmann incurs blue light contamination of the minus blue recording emulsions lying above the yellow filter; Gaspar incurs the reduced speeds and lower speed-granularity relationships of silver chloride and silver chlorobromide emulsions; and Mannes et al and Knott et al require large grain size differences to obtain an order of magnitude speed difference in the blue and minus blue recording emulsion layers, which requires either increasing granularity or significantly reducing speed in at least one emulsion layer.

Kofron et al., cited above, has recognized that the blue light absorption of high aspect ratio tabular grain silver bromide and silver bromoiodide emulsions can be sufficiently reduced so that yellow filter layers can be eliminated. However, the multicolor photographic elements of Kofron et al show significantly larger increases in the separation of blue and minus blue speeds when yellow filter layers are incorporated in the multicolor photographic elements to receive blue light prior to minus blue recording emulsion layers. Further, when Kofron et al employs high aspect ratio tabular grains of increased thickness (up to 0.5 micron) or higher iodide concentrations, significant color falsification of minus blue recording emulsion layers is possible in the absence of yellow filter protection.

In the practice of the present invention locating at least one high aspect ratio tabular grain silver iodide blue recording emulsion layer between the source of exposing radiation and the minus blue recording emulsion layers of the multicolor photographic element protects the minus blue recording emulsion layers from blue light exposure even more efficiently than most conventional yellow filter layers incorporated in multicolor photographic elements. Thus, conventional yellow filter layers can be entirely eliminated from multicolor photographic elements according to the present invention while avoiding color falsification by the minus blue recording emulsion layers. Further, this can be accomplished while employing any silver halide composition or grain configuration in the minus blue recording emulsion layers, while employing color forming layer units which are substantially matched in speed and contrast, and/or while exposing the multicolor photographic element to substantially neutral (5500° K.) light. Still further, achieving multicolor photographic elements of such capabilities are in no way incompatible with achieving the highest levels of sharpness and the highest speed-granularity capabilities of the multicolor photographic elements of this invention. Rather, the use of a blue recording high aspect ratio tabular grain silver ioidide emulsion in the multicolor photographic elements according to the present invention both avoids color falsification by blue light exposure of the minus blue recording emulsion layers and allows additional improvements in sharpness and speed-granularity relationships to be realized.

g. Examples of specific layer order arrangements

| Layer Order Arrangement I | |
|---|---|
| Exposure | |
| ↓ | |
| TB | (AGI) |
| IL | |
| G | (AgX) |
| IL | |
| R | (AgX) |

| Layer Order Arrangement II | |
|---|---|
| Exposure | |
| ↓ | |
| TG | (AgX) |
| IL | |
| TR | (AgX) |
| IL | |
| TB | (AgI) |

| Layer Order Arrangement III | |
|---|---|
| Exposure | |
| ↓ | |
| TB | (AgI) |
| IL | |
| TG | (AgI) |
| IL | |
| TR | (AgI) |

| Layer Order Arrangement IV | |
|---|---|
| Exposure | |
| ↓ | |
| TFB | (AgX) |
| IS | |
| TB | (AgI) |
| IL | |
| G | (AgX) |
| IL | |
| R | |

| Layer Order Arrangement V | |
|---|---|
| Exposure | |
| ↓ | |
| TFG | (AgX) |
| IL | |
| TFR | (AgX) |
| IL | |
| FB | (AgX) |
| TB | (AgI) + IS |
| IL | |
| FG | (AgX) |
| IL | |
| FR | (AgX) |
| IL | |
| SG | (AgX) |
| IL | |
| SR | |

where

B, G, and R designate blue, green, and red recording color-forming layer units, respectively;

T appearing before the color-forming layer unit B, G, or R indicates that the emulsion layer or layers contain a high aspect ratio tabular grain emulsion, as more specifically described above, F appearing before the color-forming layer unit B, G, or R indicates that the color-forming layer unit is faster in photographic speed than at least one other color-forming layer unit which records light exposure in the same third of the spectrum in the same Layer Order Arrangement;

S appearing before the color-forming layer unit B, G, or R indicates that the color-forming layer unit is slower in photographic speed than at least one other color-forming layer unit which records light exposure in the same third of the spectrum in the same Layer Order Arrangement;

AgI indicates that the emulsion layer or layers of the color-forming layer unit contains a silver iodide emulsion;

AgX indicates that the emulsion layer or layers of the color-forming layer unit contains a silver halide emulsion which permits most of the blue light striking it to pass through unabsorbed—e.g., silver chloride, silver bromide, or silver bromoiodide;

IL designates an interlayer containing an oxidized developing agent or electron transfer agent scavenger and, where the interlayer separates AgI and AgX containing color-forming layer units, preferably also an iodide ion scavenger; and IS designates an interlayer containing an iodide ion scavenger without necessarily including any additional scavenger.

Each faster or slower color-forming layer unit can differ in photographic speed from another color-forming layer unit which records light exposure in the same third of the spectrum as a result of its position in the Layer Order Arrangement, its inherent speed properties, or a combination of both.

In Layer Order Arrangements I through V, the location of the support is not shown. Following customary practice, the support will in most instances be positioned farthest from the source of exposing radiation—that is, beneath the layers as shown. If the support is colorless and specularly transmissive—i.e., transparent, it can be located between the exposure source and the indicated layers. Stated more generally, the support can be located between the exposure source and any color-forming layer unit intended to record light to which the support is transparent.

Turning first to Layer Order Arrangement I, the blue recording color-forming layer unit is positioned to receive exposing radiation first. This color-forming layer unit contains one or more silver halide emulsions comprised of high average aspect ratio silver iodide grains. This emulsion very efficiently absorbs the blue light and substantially none of the minus blue light incident upon it. As discussed above, the tabular silver iodide grains can be relied upon to absorb most or substantially all of the blue light of a wavelength less than 430 nm even in the absence of a blue spectral sensitizing dye. When a blue spectral sensitizing dye is present, blue light absorption by the color-forming layer unit can be extended to longer blue wavelengths. If desired to obtain a more nearly balanced blue absorption over portions of the blue spectrum longer and shorter than 430 nm in wavelength, the thickness of the tabular silver iodide grains can be reduced below about 0.1 micron down to the minimum grain thicknesses attainable.

Since the silver iodide tabular grains in the blue recording color-forming layer unit can be quite thin (0.01 micron or less) and the halide composition and projected area of the tabular silver iodide grains render them quite efficient in absorbing blue light, the blue-recording color-forming layer unit can be thinner than conventional emulsion layers or even high aspect ratio tabular grain emulsion layers of differing silver halide content, such as silver bromide or silver bromoiodide emulsion layers. The fact that the blue recording color-forming layer unit contains high aspect ratio tabular grains allows a sharper image to be produced in this color-forming layer unit. Further, the fact that the blue recording color-forming layer unit is positioned to receive imaging radiation that is substantially specular, contributes to improving the sharpness of the minus blue recording color forming layer units.

Another unexpected advantage of Layer Order Arrangement I attributable to the presence and location of the tabular grain silver iodide emulsion layer is the increased speed and speed-granularity relationship of each underlying radiation-sensitive emulsion layer. Since the tabular grain silver iodide emulsion layer requires less silver halide to absorb blue light efficiently, there is less reflection of minus blue (green and/or red) light by the silver iodide grains than would be the case if comparable blue absorption were achieved using a non-tabular emulsion or a high aspect ratio tabular grain emulsion of another halide composition. Thus, a higher percentage of minus blue light reaches the minus blue recording emulsion layers, thereby enhancing their photographic efficiency.

In any of the varied forms described above blue light, if any, contained in the light emerging from the blue-recording color-forming layer unit can be sufficiently attenuated that it is unnecessary to employ a yellow filter layer in the multicolor photographic element to protect the underlying green and red-recording color-forming layer units from blue light exposure. Hence the green and red-recording color-forming layer units can contain emulsions of any silver halide composition, including silver bromide and/or silver bromoiodide emulsions, without exhibiting color falsification. The green and red recording color-forming layer units can be of any conventional silver halide composition (including silver iodide) or grain configuration (including high aspect ratio tabular grain configuration).

In developing imagewise exposed Layer Order Arrangement I iodide ion can, but need not be released by the blue recording color-forming layer unit. Where the tabular silver iodide grains are sensitized by epitaxial deposition of a silver halide other than iodide, such as silver chloride, it is possible to develop the silver chloride selectively, as described above. In this case few, if any, iodide ions are released by development. Where the tabular silver iodide grains are developed, at least to some extent, iodide ions can be allowed to migrate to the adjacent color-forming unit to produce useful interimage effects. It is known in the art that useful interimage effects can be realized by the migration of iodide ions to adjacent color-forming layer units. Attention is drawn to Groet U.S. Pat. No. 4,082,553 for an illustrative application. However, it is generally preferred to reduce the iodide ions released to an adjacent color-forming layer unit. This can be accomplished by incorporating an iodide scavenger, such as a silver chloride or silver bromide Lippmann emulsion, in the blue recording color-forming layer unit and/or in the interlayer separating the adjacent color-forming layer unit. Because of its small grain size the Lippmann emulsion is substantially light insensitive in relation to the blue recording emulsion layer or layers.

To avoid repetition, only features that distinguish subsequent Layer Order Arrangements from previous Layer Order Arrangements are specifically discussed. In Layer Order Arrangement II the green and red recording color-forming layer units are comprised of high average aspect ratio tabular silver halide grains which permit most of the blue light striking the grains to pass through unabsorbed. This can be permitted by the composition of the grains (i.e., the absence of or low concentrations of iodide) and/or diminished thicknesses of the grains. In a particularly preferred form of Layer Order Arrangement II the blue recording color-forming layer unit is coated on a reflective support, such as a white support. It is well appreciated that both initially incident radiation and initially unabsorbed reflected radiation contribute to exposure of emulsion layers coated on white reflective supports. In Layer Order Arrangement II the tabular silver iodide grains absorb blue light initially incident upon them and, if any blue light is not initially absorbed, these grains also absorb blue light reflected by the support. Thus the green and red recording color-forming layer units are protected from blue light exposure by reflection. The use of the silver iodide tabular grains in the blue recording color-forming layer unit significantly reduces the blue exposure of the minus blue recording emulsion layers even though the blue recording color-forming layer unit is not interposed between the radiation source and the minus blue recording color-forming layer units.

Since each of the color-forming layer units in Layer Order Arrangement II are comprised of high average aspect ratio silver halide grains, very high levels of sharpness are possible. Further, Layer Order Arrangement II offers a significant advantage in that the green recording color-forming layer unit is positioned nearest the source of exposing radiation. This allows a sharper image to be produced in the green color-forming layer unit as well as permitting its speed-granularity relationship to be improved. Since the human eye is more sensitive to the green recording color-forming layer unit image than the images produced in the remaining color-forming layer units, the advantages realized in the green recording color-forming layer unit are highly advantageous in achieving the best overall multicolor photographic image.

Layer Order Arrangment III differs from Layer Order Arrangement I in that the green and red recording color-forming layer units both contain high aspect ratio tabular grain silver iodide emulsions. In view of the capability of producing extremely thin tabular silver iodide grains, this allows the color-forming layer units to be substantially reduced in thickness. This in turn allows sharper photographic images to be produced, particularly in the red recording color-forming layer unit, although where a white reflective support is employed, significant improvements in sharpness may be realized in each of the color-forming layer units. Although the minus blue color-forming layer units are highly efficient in recording blue light, they are protected from blue light exposure by the overlying tabular silver iodide grains in the blue recording color-forming layer unit.

Layer Order Arrangement IV differs from Layer Order Arrangement I by the addition of an additional blue recording color forming layer unit containing a fast high aspect ratio tabular grain silver halide emulsion the halide of which need not be silver iodide. By containing high aspect ratio tabular grains the additional blue color-forming layer unit avoids scattering incident radiation which would degrade the sharpness of imaging records in underlying emulsion layers. The fast blue-recording layer unit is relied upon to achieve a blue speed which matches the green and red speeds of the underlying emulsion layers. The high aspect ratio tabular silver iodide emulsion can be used to extend the exposure latitude of the fast blue recording color-forming layer unit while at the same time more efficiently protecting the underlying color-forming layer units from blue light exposure. Since the two blue recording color-forming layer units are adjacent each other, there is no need to provide an interlayer for oxidized developing agent scavenger. However, since the blue recording color-forming layer units are of differing halide composition, the inclusion of an iodide scavenger in an interlayer between the color-forming layer units is shown, although neither the use of an interlayer or an iodide scavenger is essential. The iodide scavenger can be incorporated in either or both blue recording color-forming layer units, but is preferably incorporated in the one containing tabular silver iodide grains. Iodide scavenger can also be present in the interlayer separating the tabular silver iodide grain containing blue recording color-forming layer unit from the green recording color-forming layer unit.

Layer Order Arrangement V illustrates the application of the invention to a multicolor photographic element containing multiple blue, green, and red color-forming layer units. Incident radiation initially strikes a green recording color-forming layer unit comprised of a substantially optimally sensitized high aspect ratio tabular grain silver halide emulsion, preferably a silver bromoiodide emulsion. The light then passes through to an underlying red recording color-forming layer unit, which can be identical to the green recording color-forming layer unit above, except that the silver halide emulsion is sensitized to red light. These two minus blue recording color-forming layer units by reason of their favored location for receiving exposing radiation and because of the exceptional speed-granularity relationships of substantially optimally sensitized high aspect ratio tabular grain emulsions can exhibit exceptionally high speeds. Since speed is normally measured near the toe of a negative-working emulsion characteristic curve, typically at a density of about 0.1 above fog, it is not necessary that the two upper minus blue recording color-forming layer units be capable of producing by themselves high dye densities in order to increase the minus blue speed of the photographic element. Therefore it is specifically contemplated that these minus blue recording color-forming layer units can be exceptionally thin. The use of thin coatings is, of course, compatible with the use of tabular grain emulsions.

After passing through the upper two minus blue recording color-forming layer units, light is received by a fast blue recording color-forming layer unit. Although the fast blue recording color-forming layer unit can contain one or more silver halide emulsion layers of any conventional type, this color-forming layer unit is preferably identical to the fast blue color-forming layer unit described in connection with Layer Order Arrangement IV. To protect the underlying minus blue recording color-forming layer units from blue light exposure, a second blue recording color-forming layer unit is shown containing a high aspect ratio tabular grain silver iodide emulsion. An iodide scavenger is also shown in this color-forming layer unit. It is appreciated that the blue recording silver halide emulsions can be present, if desired, in the same color-forming layer unit, either blended or, preferably, coated as separate layers.

Immediately beneath the blue recording color-forming layer units are two fast minus blue recording color-forming layer units, a green and a red color-forming layer unit in that order. Since the emulsions of these color-forming layer units are protected from blue light exposure by the high aspect ratio tabular silver iodide grains in the overlying blue recording color-forming layer unit, the silver halide emulsions in these two fast minus blue recording color-forming layer units can be from among any green or red sensitized emulsions heretofore described. In a preferred form the green and red sensitized silver halide emulsions are identical to those of the outermost two color-forming layer units. That is, these minus blue recording color-forming layer units preferably also contain substantially optimally sensitized high aspect ratio tabular grain emulsions, most preferably silver bromoiodide emulsions.

The two minus blue recording color-forming layer units farthest from the exposing radiation source are labeled slow color-forming green and red recording color-forming layer units. Their function is to extend the exposure latitude of the photographic element and to contribute additional density for achieving maximum dye densities in the case of a negative-working photographic element. The emulsions employed can be of any conventional type. They can be identical to the silver halide emulsions employed in the other minus blue-recording color-forming layer units, relying on their less favored layer order arrangement to reduce their effective speed. Speed-granularity advantages are realized by coating faster and slower emulsions in separate layers as opposed to blending the emulsions.

The multicolor photographic elements of the present invention can, if desired, be applied to image transfer applications. For example, a multicolor photographic elements can form a part of a multicolor image transfer film unit. When the photographic elements are employed in image transfer film units they incorporate dye image providing materials which undergo an alteration of mobility as a function of silver halide development. An image dye receiver can form a part of the image transfer film unit or be separate therefrom. Useful image transfer film unit features are disclosed in *Research Disclosure,* Item 17643, cited above, Paragraph XXIII; *Research Disclosure,* Vol. 152, Nov. 1976, Item 15162; and Jones and Hill U.S. Ser. No. 431,855, cited above, the disclosures of which are here incorporated by reference. The image transfer film units disclosed by Jones and Hill are particularly preferred for image transfer applications of the photographic elements of this invention.

While the invention has been described above in terms of a high aspect ratio tabular grain silver iodide emulsion layer being employed as a blue recording emulsion layer, it is appreciated that this emulsion layer can be employed in other ways and still perform its desired function of reducing blue light exposure of the minus blue recording emulsion layers. The tabular grain silver iodide emulsion layer can, for example, be employed as an additional layer in a multicolor photographic element and not be relied upon to record light exposures. If a separate blue recording emulsion layer is present in the multicolor photographic element, the tabular grain silver iodide emulsion layer can merely supplement the blue recording capability of this separate emulsion layer or the tabular grain silver iodide emulsion layer can simply not produce any useful record of light exposure. The latter can occur if the tabular grain silver iodide emulsion layer is not sufficiently sensitized or is desensitized. If the tabular grain silver iodide emulsion layer lacks access to dye image providing material—e.g., no dye-forming coupler is present in this layer and this layer is separated from any other dye-forming coupler layer by oxidized developing agent scavenger, the result is realized of producing no visible record of light exposure even though the emulsion produces an otherwise useful latent image. When the tabular grain silver iodide emulsion layer is not relied upon to record exposing radiation, it remains useful in absorbing blue light that would otherwise contaminate the minus blue record of the multicolor photographic element. In this instance the tabular grain silver iodide emulsion layer should lie between at least one of the minus blue recording layers and the source of exposing radiation. In this application the tabular grain silver iodide emulsion layer can be an advantageous alternative to conventional yellow filter layers in providing more specular (i.e., less scattered) transmission of minus blue light and absorbing less minus blue light in proportion to the amount of blue light adsorbed.

Instead of employing the tabular grain silver iodide emulsion layer to record blue light, it can be relied upon alternatively to record minus blue light by use of an adsorbed green or red spectral sensitizing dye. When so employed the tabular silver iodide emulsion layer protects any underlying minus blue recording emulsion layer from blue light exposure just as efficiently as when the tabular grain silver iodide emulsion layer is employed to record blue light. Although the absorption by the tabular grain silver iodide emulsion layer of both blue and red or green light when so employed is normally a disadvantage, it can be tolerated for some applications and is particularly tolerable when the blue light absorbed is only a fraction of (preferably approximately an order of magnitude less than) the green or red light being recorded.

EXAMPLES

The preparation and sensitization of high aspect ratio tabular grain silver iodide emulsions is illustrated by the following specific examples:

EMULSION PREPARATION AND SENSITIZATION EXAMPLES

In each of the examples the contents of the reaction vessel were stirred vigorously throughout silver and iodide salt introductions; the term "percent" means percent by weight, unless otherwise indicated; and the term "M" stands for a molar concentration, unless otherwise stated. All solutions, unless otherwise stated, are aqueous emulsions.

Example Emulsions 1 through 4 relate to silver halide emulsions in which the tabular silver iodide grains are of a face centered cubic crystal structure.

EXAMPLE EMULSION 1

Tabular Grain Silver Iodide Emulsion 6.0 liters of a 5 percent deionized bone gelatin aqueous solution were placed in a precipitation vessel and stirred at pH 4.0 and pAg calculated at 1.6 at 40° C. A 2.5 molar potassium iodide solution and a 2.5 molar silver nitrate solution were added for 5 minutes by double-jet addition at a constant flow rate consuming 0.13 percent of the silver used. Then the solutions were added for 175 minutes by accelerated flow (44 X from start to finish) consuming 99.87 percent of the silver used. Silver iodide in the amount of 5 moles was precipitated.

The emulsion was centrifuged, resuspended in distilled water, centrifuged, resuspended in 1.0 liters of a 3 percent gelatin solution and adjusted to pAg 7.2 measured at 40° C. The resultant tabular grain silver iodide emulsion had an average grain diameter of 0.84 μm, an average grain thickness of 0.066 μm, an aspect ratio of 12.7:1, and greater than 80 percent of the grains were tabular based on projected area. Using x-ray powder diffraction analysis greater than 90 percent of the silver iodide was estimated to be present in the γ phase. See FIG. 1 for a carbon replica electron micrograph of a sample of the emulsion.

EXAMPLE EMULSION 2

Figure 2:
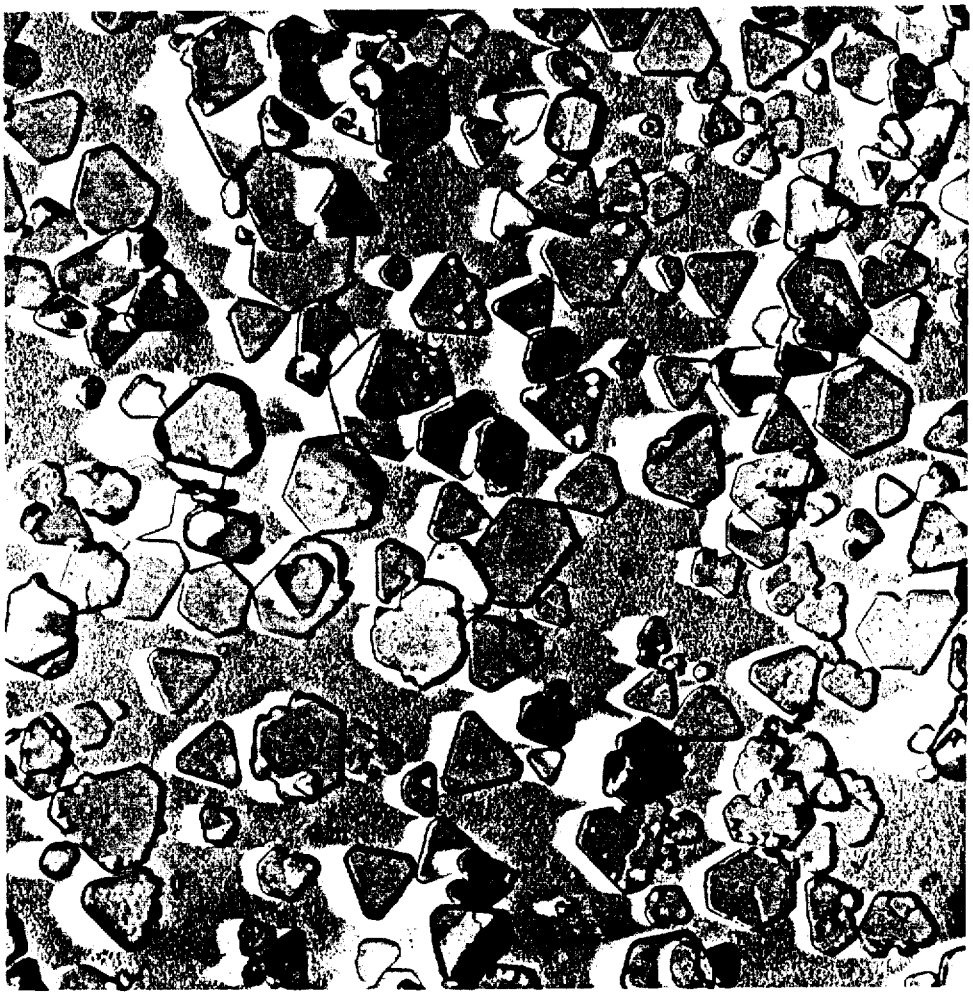

Epitaxial AgCl on Tabular Grain AgI Emulsion 29.8 g of the tabular grain AgI emulsion (0.04 mole) prepared in Example 1 was brought to a final weight of 40.0 g with distilled water and placed in a reaction vessel. The pAg was measured as 7.2 at 40° C. Then 10 mole percent silver chloride was precipitated onto the AgI host emulsion by double-jet addition for approximately 16 minutes of 0.5 molar NaCl solution and a 0.5 molar $AgNO_3$ solution at 0.5 ml/minute. The pAg was maintained at 7.2 throughout the run. See FIG. 2 for a carbon replica photomicrograph of a sample of the emulsion.

EXAMPLE EMULSION 3

Epitaxial AgCl plus Iridium on Tabular Grain AgI Emulsion

Emulsion 3 was prepared similarly to the epitaxial AgCl tabular grain AgI emulsion of Example 2 with the exception that 15 seconds after the start of the silver salt and halide salt solutions 1.44 mg of an iridium compound/Ag mole was added to the reaction vessel.

Example Emulsions 1, 2 and 3 were each coated on a polyester film support at 1.73 g silver/$m^2$ and 3.58 g gelatin/$m^2$. The coatings were overcoated wlth 0.54 g gelatin/$m^2$ and contained 1.0 percent bis(vinylsulfonylmethyl)ether hardener based on total gelatin content. The coatings were exposed for ½ second to a 600 W 2850° K. tungsten light source through a 0–6.0 density step tablet (0.30 steps) and processed for 6 minutes at 20° C. in a total (surface+internal) developer of the type described by Weiss et al U.S. Pat. No. 3,826,654.

Sensitometric results reveal that for the tabular grain AgI host emulsion (Emulsion 1) no discernible image was obtained. However, for the epitaxial AgCl (10 mole percent)/tabular grain AgI emulsion (Emulsion 2), a significant negative image was obtained with a D-min of 0.17, a D-max of 1.40, and a contrast of 1.7. For the iridium sensitized epitaxial AgCl (10 mole percent)-/tabular grain AgI emulsion (Emulsion 3) a negative image was obtained with a D-min of 0.19, a D-max of 1.40, a contrast of 1.2, and approximately 0.5 log E faster in threshold speed than Emulsion 2.

EXAMPLE EMULSION 4

The Use of Phosphate to Increase the Size of AgI Tabular Grains

This emulsion was prepared similar to Example Emulsion 1 except that it contained 0.011 molar $K_2HPO_4$ in the precipitation vessel and 0.023 molar $K_2HPO_4$ in the 2.5 molar potassium iodide solution.

The resultant tabular grain emulsion was found to consist of silver iodide. No phosphorus was detectable using x-ray microanalysis. The AgI tabular grain emulsion had an average grain diameter of 1.65 μm compared to 0.84 μm found for Example Emulsion 1, an average grain thickness of 0.20 μm, an aspect ratio of 8.3:1, and greater than 70 percent of the grains were tabular based on projected area. Greater than 90 percent of the silver iodide was present in the Y phase as determined by x-ray powder diffraction analysis.

Example Emulsions 5 through 8 relate to silver halide emulsions in which the tabular silver iodide grains are of a hexagonal crystal structure, indicating the silver iodide to be present predominantly in the β phase.

EXAMPLE EMULSION 5

Figure 3:
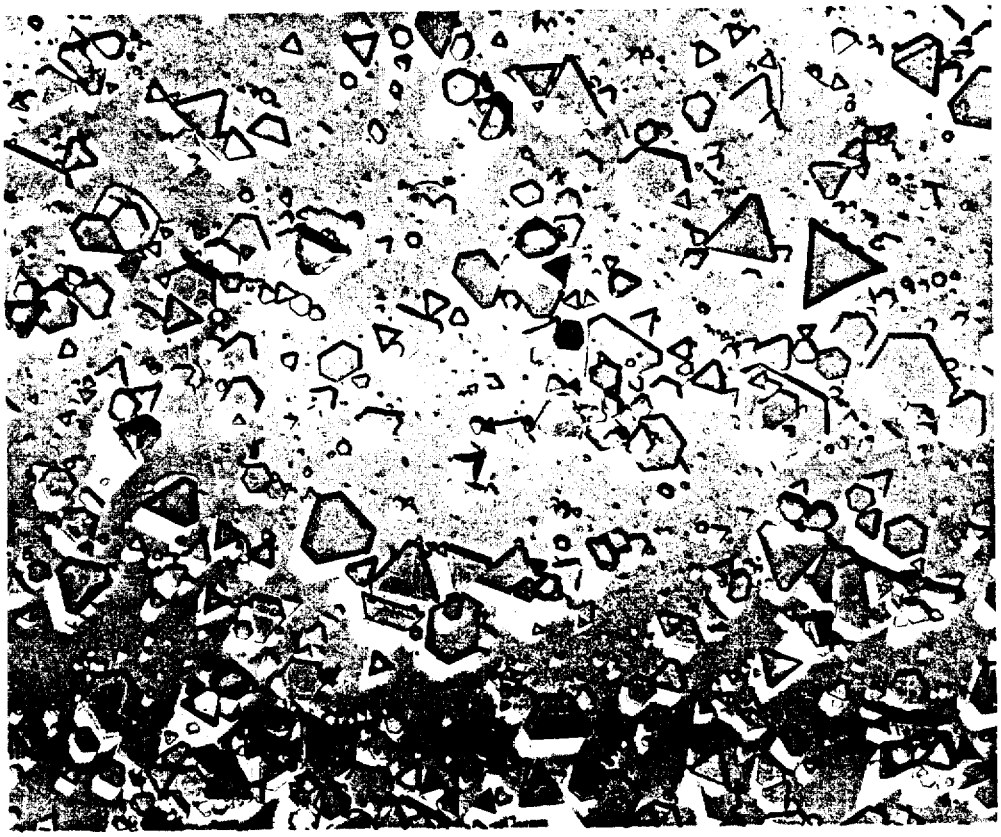

Tabular Grain AgI Emulsion 4.0 liters of a 2.0 percent deionized phthalated gelatin aqueous solution containing 0.08 molar potassium iodide were placed in a precipitation vessel with stirring. The pH was adjusted to 5.8 at 40° C. The temperature was increased to 80° C. and the pI was determined to be 1.2. Then a 1.0 molar potassium iodide solution at 45° C. and a 0.06 molar silver nitrate solution at 45° C. were run concurrently into the precipitation vessel by double-jet addition. The silver salt solution was added for 138.9 minutes by accelerated flow (3.5 X from start to finish) utilizing 0.3 mole of silver. The iodide salt solution was added at a rate sufficient to maintain the pI at 1.2 at 80° C. throughout the run. The emulsion was cooled to 30° C., washed by the coagulation method of Yutzy and Frame, U.S. Pat. No. 2,614,928, and stored at pH 5.8 and pAg 9.5 measured at 40° C. The resultant tabular grain silver iodide emulsion had an average grain diameter of 2.5 μm, an average thickness of 0.30 μm, an average aspect ratio of 8.3:1, and greater than 75 percent of the projected area was provided by tabular grains. See FIG. 3 for a photomicrograph of Emulsion 5.

EXAMPLE EMULSION 6

Tabular Grain AgI Host Emulsion 5.0 liters of a 2.0 percent deionized phthalated gelatin aqueous solution (Solution A) containing 0.04 molar potassium iodide were placed in a precipitation vessel with stirring and the pH was adjusted to 5.8 at 40° C. The temperature was increased to 90° C. and the pI was determined to be 1.6. Then a 1.0 molar potassium iodide solution at 70° C. (Solution B) and a $6.95\times10^{-2}$ molar $AgNO_3$ solution at 70° C. (Solution C) were run concurrently into Solution A by double-jet addition. Solution C was added for 125 minute by accelerated flow (2.23 X from start to finish consuming 6.4 percent of the total silver used. Solution C was then added at accelerated flow rates in five intervals of 125 minutes, 150 minutes, 150 minutes, 150 minutes, and 20 minutes each consuming 13.7 percent, 20.8 percent, 25.3 percent, 29.7 percent, and 4.0 percent, respectively, of the total silver used. Solution B was added concurrently throughout at flow rates sufficient to maintain the pI at 1.6 at 90° C. The emulsion was cooled to 30° C., washed by the coagulation method of Yutzy and Frame U.S. Pat. No. 2,614,928, and stored at pH 6.0 and pAg 9.5 measured at 40° C. Approximately $7.6\times10^{-1}$ mole of silver was used to prepare this emulsion. The resultant tabular grain silver iodide emulsion had an average grain diameter of 7.7 μm, an average thickness of 0.35 μm, an aspect ratio of 22:1, and greater than 75 percent of the projected area was provided by the tabular grains.

EXAMPLE EMULSION 7

Silver Bromide (10 mole percent) Depostion on Tabular Grain AgI Emulsion

A total of 2.03 liters of a 0.98 percent deionized phthalated gelatin aqueous solution containing 444.0 g (0.44 mole) of Emulsion 6 were placed in a precipitation vessel with stirring. The pH was adjusted to approximately 6.2. The pAg was adjusted to approximately 7.6 at 40° C. using a $1\times10^{-3}$ molar potassium bromide solution. Then a 0.1 molar potassium bromide solution at 40° C. and a 0.1 molar silver nitrate solution at 40° C. were run concurrently into the precipitation vessel by double-jet addition. The silver salt solution was added for 30 minutes at 14.8 ml/minute while the bromide salt solution was added at a rate sufficient to maintain the pAg at 7.6 at 40° C. Approximately 10 mole percent silver bromide was added to the tabular grain silver iodide host emulsion. The emulsion was cooled to 30° C., washed by the coagulation method of Yutzy and Frame U.S. Pat. No. 2,614,928, and stored at pH 5.8 and pAg 8.2 measured at 40° C.

The silver bromide epitaxially deposited was almost exclusively along the edges of the tabular silver iodide host crystals.

EXAMPLE EMULSION 8

Silver Chloride (10 mole percent) Depostion on Tabular Grain AgI Emulsion

A total of 1.98 liters of a 1.26 percent deionized phthalated gelatin aqueous solution containing 486.0 g (0.44 mole) of an Emulsion 6 repeat were placed in a precipitation vessel with stirring. The pH was adjusted to approximately 6.0. The pAg was adjusted to approximately 6.9 at 40° C. using a 1.0 molar potassium chloride solution. Then a $9.25\times10^{-2}$ molar potassium chloride solution at 40° C. and a $9.25\times10^{-2}$ molar silver nitrate solution at 40° C. were run concurrently into the precipitation vessel by double-jet addition. The silver salt solution was added for 60 minutes at 8.0 ml/minute while the chloride salt solution was added at a rate such that the pAg changed from 6.9 to 6.7 at 40° C. throughout the run. Approximately 10 mole percent silver chloride was added to the tabular grain silver iodide host emulsion. The emulsion was cooled to 30° C., washed by the coagulation method of Yutzy and Frame U.S. Pat. No. 2,614,928, and stored at pH 5.0 and pAg 7.2 measured at 40° C.

The silver chloride epitaxially deposited was almost exclusively along the edges of the tabular silver iodide host crystals.

Example Emulsions 6, 7, and 8 were separately coated on polyester film support at 1.61 g silver/$m^2$ and 5.38 g gelatin/$m^2$. The coating elements also contained 1.61 g yellow coupler α-pivalyl-α[4-(4-hydroxybenzenesulfonyl)-phenoxy]-2-chloro-5-(n-hexadecanesulfonamido)-acetanilide/$m^2$, 3.29 g 2-(2-octadecyl)-5-sulfohydroquinone, sodium salt/Ag mole and 1.75 g 4-hydroxy-6-methyl-1,3,3*a*,7-tetraazaindene/Ag mole. The coating elements were overcoated with a 0.89 g gelatin/$m^2$ layer that contained 1.75 percent by weight hardener bis(vinylsulfonylmethyl)ether based on total gelatin content. Emulsion 8 was also spectrally sensitized with 0.25 millimole anhydro-5,5'-dichloro-3,3'-bis(3-sulfopropyl)thiacyanine hydroxide trimethylamine salt/Ag mole and then chemically sensitized with 15 mg gold sulfide/Ag mole for 5 minutes at 55° C. and coated as described above.

The coatings were exposed for 1/10 second to a 600 watt 3000° K. tungsten light source through a 0–6.0 density step tablet (0.30 steps) and processed for either 3 or 6 minutes at 37.7° C. in a color developer of the type described in *The British Journal of Photography Annual*, 1979, pages 204–206.

Blue sensitometry was obtained. Sensitometric results revealed that for Emulsion 6, the tabular grain AgI host emulsion, no discernible image was obtained at either 3 minutes or 6 minutes development time. Emulsion 7, the AgBr deposited on AgI host emulsion, resulted in a significant negative image at 6 minutes development with a D-min of 0.13, a D-max of 0.74, and a contrast of 0.42. Unsensitized Emulsion 8, the AgCl deposited on AgI host emulsion, resulted in a substantial negative image at 3 minutes development with a D-min of 0.13, a D-max of 0.74, and a contrast of 0.80. Furthermore, the chemically and spectrally sensitized Emulsion 8 which had a D-min of 0.13, D-max of 0.80, and contrast of 0.65, was approximately 0.60 log E faster in speed than unsensitized Emulsion 8.

EXAMPLE EMULSION 9

Tabular Grain AgI Host Emulsion 5.0 liters of a 2.0 percent deionized gelatin aqueous solution containing 0.04 molar potassium iodide were placed in a precipitation vessel with stirring. The pH was adjusted to 5.8 at 40° C. The temperature was increased to 90° C. and the pI was determined to be 1.4. Then a 0.5 molar potassium iodide solution and a 0.07 molar silver nitrate solution were run concurrently into the precipitation vessel by double-jet addition. The silver salt solution was added in six increments according to the following flow profile.

| | Silver Salt Addition Profile | |
|---|---|---|
| Run Time | Accelerated flow (Start to Finish) | Percent of Total Silver |
| 125' | 2.23 × | 6.1 |
| 125' | 1.55 × | 10.8 |
| 150' | 1.43 × | 19.2 |
| 150' | 1.3 × | 26.1 |
| 150' | 1.23 × | 32.9 |
| 20' | 1.03 × | 4.9 |

Figure 4:
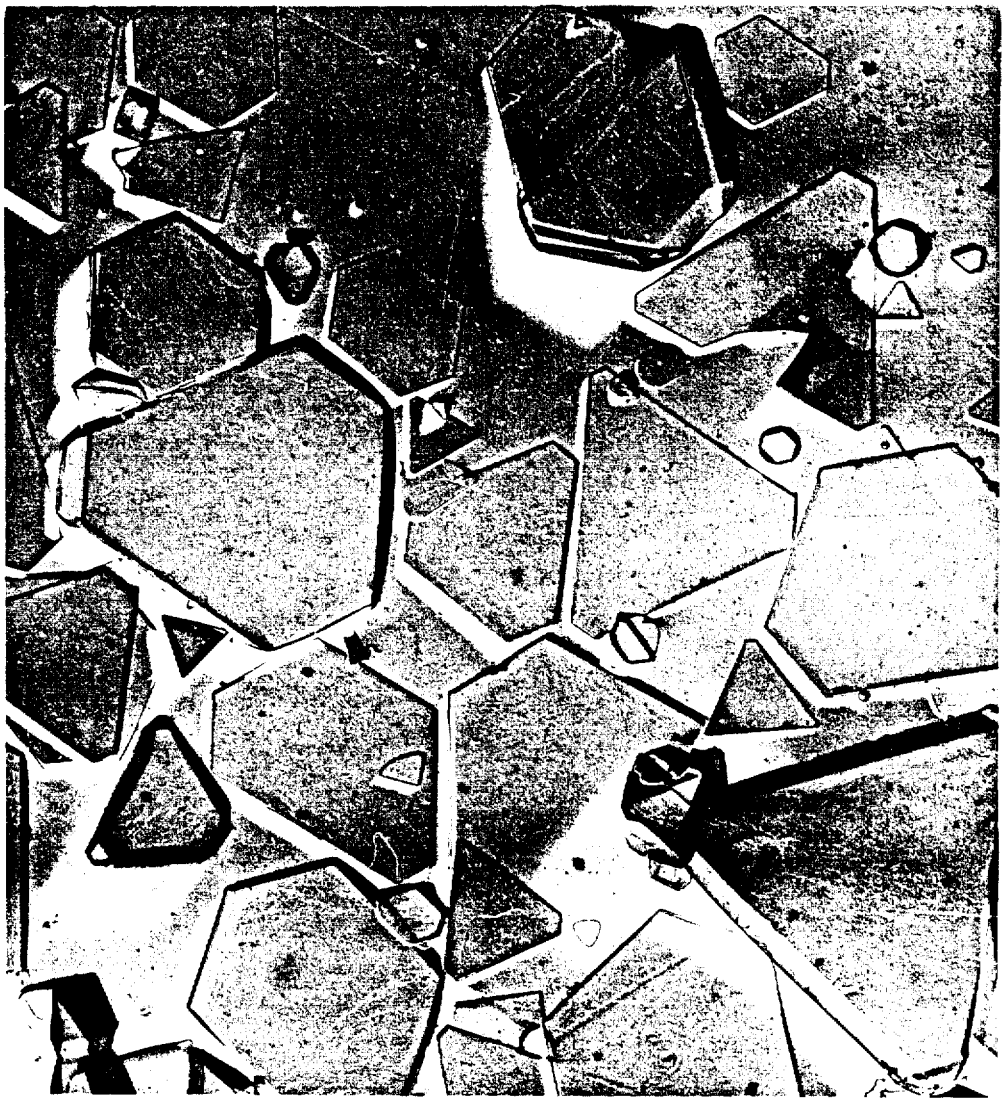

A total of approximately 0.8 mole of silver was utilized. The iodide salt solution was added at a rate sufficient to maintain the pI at approximately 1.4 at 90° C. throughout the precipitation. The emulsion was cooled to 30° C. and washed by the coagulation method of Yutzy and Frame U.S. Pat. No. 2,614,928. The resultant tabular grain silver iodide emulsion had an average grain diameter of 11.4 μm, an average grain thickness of 0.32 μm, an average aspect ratio of 35.6:1, and greater than 75 percent of the projected surface area was contributed by the tabular silver iodide grains. See FIG. 4 for a photomicrographic of Emulsion 9.

EXAMPLE EMULSION 10

Silver Chloride (10 mole percent) Deposition on Tabular Grain AgI Emulsion

A sample of Emulsion 9 in the amount of 1048 grams (1.3 mole AgI) prepared above was placed in a precipitation vessel. Next 1.3 liters of distilled water were added and the emulsion was adjusted to pAg 7.0 at 40°

Figure 5:
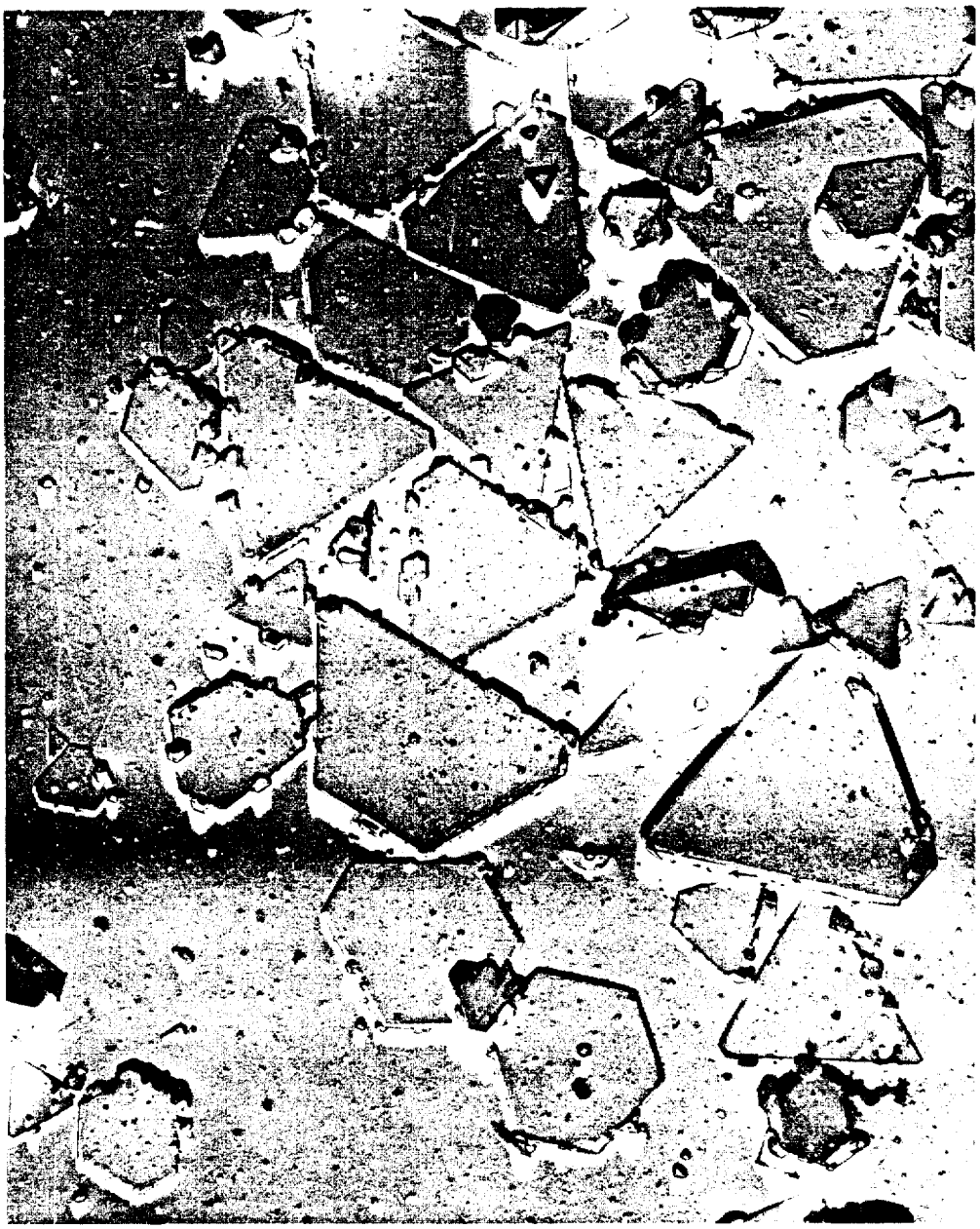

C. using a 1.0 molar KCl solution. Then a 1.0 molar KCl solution and a 0.46 molar $AgNO_3$ solution were added over two hours by double-jet utilizing accelerated flow (2 x from start to finish) at controlled pAg 7.0 at 40° C. A total of 10 mole percent silver chloride was precipitated onto the silver iodide host Emulsion 9. Following precipitation the emulsion was cooled to 30° C. and washed by the coagulation method of Yutzy and Frame U.S. Pat. No. 2,614,928. See FIG. 5 for a photomicrograph of Emulsion 10.

EXAMPLE EMULSION 11

Silver Bromide (5 mole percent) Deposition on Tabular Grain AgI Emulsion

A tabular grain AgI emulsion was prepared by a double-jet precipitation technique. The emulsion had an average grain diameter of 6.0 μm, an average grain thickness of 0.23 μm, an average aspect ratio of 26:1, and greater than 75 percent of the projected surface area was contributed by the tabular silver iodide grains.

Figure 6:
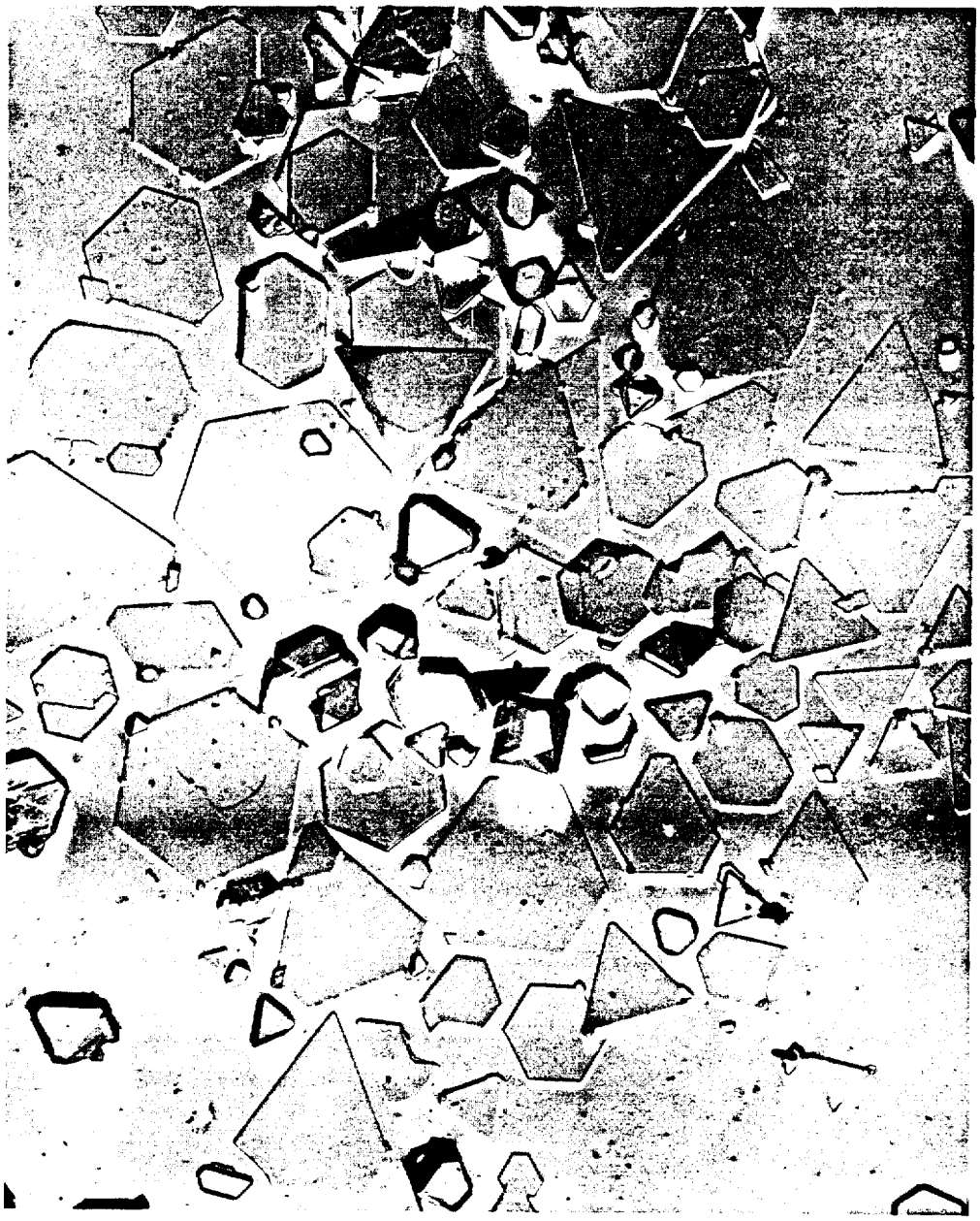

The tabular grain silver iodide emulsion in the amount of 600 grams (1.0 mole AgI) was placed in a precipitation vessel. Next 1.6 liters of distilled water were added and the emulsion was adjusted to pAg 8.0 at 40° C. using a 1.0 molar KBr solution. Then a 1.0 molar KBr solution and a 0.037 molar $AgNO_3$ solution were added over eight hours by double-jet utilizing accelerated flow (5 x from start to finish) at controlled pAg 8.0 at 40° C. A total of 5 mole percent silver bromide was precipitated onto the silver iodide host emulsion. Following precipitation the emulsion was cooled to 30° C. and washed by the coagulation method of Yutzy and Frame U.S. Pat. No. 2,614,928. See FIG. 6 for a photomicrograph of Emulsion 11.

MULTICOLOR PHOTOGRAPHIC ELEMENT EXAMPLE

Three silver halide emulsions of near equivalent grain volumes were prepared by double-jet precipitation techniques. The emulsions were separately coated in the blue layer of multilayer elements and compared for the blue light absorption in the green recording layer. Emulsion A was a three-dimensional grain silver iodide with an average grain size of 0.75 μm and an average grain volume of $0.22(\mu m)^3$. Emulsion B was a tabular grain silver bromoiodide (97:3) emulsion with an average grain diameter of 1.8 μm, an average grain thickness of 0.099 μm, an aspect ratio of 18:1, an average projected area of greater than 80%, and an average grain volume of $0.25\ (\mu m)^3$. Emulsion C, satisfying the requirements of this invention, was a tabular grain silver iodide emulsion with an average grain diameter of 1.7 μm, an average grain thickness of 0.095 μm, an average aspect ratio of 17.9:1, a tabular grain projected area of greater than 50% of the total grain projected area, and an average grain volume of $0.21\ (\mu m)^3$.

Each emulsion was coated in the blue layer (Layer 9) at 0.97 g. silver/$m^2$ and 1.51 g. gelatin/$m^2$. Layer 9 also contained 2-(2-octadecyl)-5-sulfohydroquinone, sodium salt at 0.30 g/$m^2$ and 4-hydroxy-6-methyl-1,3,3*a*,7-tetraazaindene at 2.27 g/$m^2$. No yellow filter layer was present in the multilayer element.

The remaining film structure coated on cellulose triacetate support is described below.

Layer 1: A slow cyan imaging component containing a blend of a red sensitized tabular grain (0.16 μm thick × 5.3 μm diameter) silver bromoiodide (97:3) emulsion and a red sensitized 0.55 μm three-dimensional grain silver bromoiodide (97:3) emulsion in a 1.7:1 ratio coated at 2.48 g. silver/$m^2$ and 2.56 g. gelatin/$m^2$. Also present were cyan dye-forming coupler at 0.94 g/$m^2$, 2-(2-octadecyl)-5-sulfohydroquinone, sodium salt at 0.08 g/$m^2$ and 4-hydroxy-6-methyl-1,3,3*a*,7-tetraazaindene at 0.80 g/$m^2$.

Layer 2: Gelatin interlayer at 0.61 g/$m^2$.

Layer 3: A slow magenta imaging component containing a blend of a green sensitized tabular grain (0.16 μm thick × 5.3 μm diameter) silver bromoiodide (97:3) emulsion, a green sensitized 0.55 μm three-dimensional grain silver bromoiodide (97:3) emulsion, and a green sensitized 0.21 μm three-dimensional green silver bromoiodide (95.2:4.8) emulsion in a ratio of 4.2:3.2:1 coated at 2.73 g. silver/$m^2$ and 2.70 g. gelatin/$m^2$. Also present were magenta coupler at 0.82 g/$m^2$, 2-(2-octadecyl)-5-sulfohydroquinone, sodium salt at 0.11 g/$m^2$, and 4-hydroxy-6-methyl-1,3,3*a*,7-tetraazaindene at 0.44 g/$m^2$.

Layer 4: Gelatin interlayer at 0.61 g/$m^2$.

Layer 5: A fast cyan imaging component containing a red sensitized tabular grain (0.16 μm thick × 5.3 μm diameter) silver bromoiodide (97:3) emulsion coated at 1.83 g. silver/$m^2$ and 1.83 g. gelatin/$m^2$. Also present were cyan coupler 0.22 g/$m^2$, 2-(2-octadecyl)-5-sulfohydroquinone, sodium salt at 0.06 g/$m^2$, and 4-hydroxy-6-methyl-1,3,3*a*,7-tetraazaindene at 1.25 g/$m^2$.

Layer 6: Gelatin interlayer at 0.61 g/$m^2$.

Layer 7: A fast magenta imaging component containing a green sensitized tabular grain (0.16 μm thick × 5.3 μm diameter) silver bromoiodide (97:3) emulsion coated at 1.83 g. silver/$m^2$ and 2.09 g. gelatin/$m^2$. Also present were magenta coupler at 0.16 g/$m^2$, 2-(2-octadecyl)-5-sulfohydroquinone, sodium salt at 0.06 g/$m^2$, and 4-hydroxy-6-methyl-1,3,3*a*,7-tetraazaindene at 1.25 g/$m^2$.

Layer 8: Gelatin interlayer at 0.81 g/$m^2$.

The multilayer element was overcoated with 1.36 g gelatin/$m^2$ and hardened with 2.0% bis(vinylsulfonylmethyl) ether based on the total gelatin content.

A control coating was also prepared with the exception that the silver halide emulsion was omitted from Layer 9. Gelatin was coated at 1.51 g/$m^2$ in that layer. The remaining layers were the same as described above.

Each coating was exposed for 1/10 second to a 600 W 5500° K. tungsten light source through a 0-6.0 density step tablet (0.30 steps) plus Wratten 36 + 38A filter (permitting only 350 to 460 nm wavelength light to be transmitted) and processed for 2 ½ minutes in a color developer of the type described in the *British Journal of Photography Annual*, 1979, pages 204–206.

To provide a measure of the blue light transmitted through Layer 9, a characteristic curve of the magenta record was plotted for each multicolor element, and the speed of the magenta record was measured. Lower magenta speeds indicate lower levels of blue light transmission.

TABLE VI

| Coating | Magenta Record Relative Blue Speed |
|---|---|
| Control | 100 |
| Emulsion A (three-dimensional grain AgI) | 41 |
| Emulsion B (tabular grain AgBrI) | 83 |

TABLE VI-continued

| Coating | Magenta Record Relative Blue Speed |
|---|---|
| Emulsion C (tabular grain AgI) | 32.5 |

30 relative speed units + 0.30 log E, where E is exposure measured in meter-candle-seconds.

As shown in Table VI the multicolor element containing Emulsion C provided the lowest relative blue speed in the magenta record layer. This indicated that of the three emulsions of near equivalent grain volumes, the tabular grain silver iodide emulsion absorbed the greatest amount of blue light. The improvement of Emulsion C over Emulsion A demonstrated that blue light absorption by silver iodide occurred due to projected surface area rather than grain volume. These results show that by coating a high aspect ratio tabular grain silver iodide emulsion in a blue recording layer less unwanted blue light is transmitted to the underlying emulsion layers.

The invention has been described in detail with particular reference to preferred embodiments thereof, but it will be understood that variations and modifications can be effected within the spirit and scope of the invention.

What is claimed is:

1. In a photographic element capable of producing a multicolor image comprised of a support and, located on said support, superimposed emulsion layers for facilitating separate recording of blue, green, and red light, each comprised of a dispersing medium and silver halide grains, the improvement comprising at least 50 percent of the total projected area of said silver halide grains in at least one emulsion layer being provided by thin tabular silver iodide grains having a thickness of less than 0.3 micron and an average aspect ratio of greater than 8:1.

2. A photographic element according to claim 1 wherein said one emulsion layer is a blue recording element layer.

3. A photographic element according to claim 1 wherein said tabular silver iodide grains have an average aspect ratio of at least 12:1.

4. A photographic element according to claim 1 wherein said tabular silver iodide grains account for at least 70 percent of the total projected area of said silver halide grains in said one blue recording emulsion layer.

5. A photographic element according to claim 1 wherein silver salt is epitaxially located on said tabular silver iodide grains.

6. A photographic element according to claim 5 wherein said silver salt is comprised of a silver halide.

7. A photographic element according to claim 6 wherein said silver salt is comprised of silver chloride.

8. A photographic element according to claim 6 wherein said silver salt is comprised of silver bromide.

9. A photographic element according to claim 4 wherein said silver salt is epitaxially located on less than 25 percent of the total surface area provided by the major crystal faces of said tabular silver iodide grains.

10. A photographic element according to claim 9 wherein said silver salt is epitaxially located on less than 10 percent of the total surface area provided by the major crystal faces of said tabular silver iodide grains.

11. A photographic element according to claim 1 wherein said tabular silver iodide grains have an average thickness greater than 0.005 micron.

12. A photographic element according to claim 1 wherein said tabular silver iodide grains have an average thickness greater than 0 01 micron.

13. A photographic element according to claim 2 wherein said tabular silver iodide grains have an average thickness of less than 0.1 micron and said emulsion additionally contains a blue spectral sensitizing dye having an absorption peak of a wavelength longer than 430 nanometers.

14. A photographic element according to claim 1 wherein said tabular silver iodide grains have an average thickness greater than 0.1 micron.

15. A photographic element according to claim 14 wherein said tabular silver iodide grains have an average thickness greater than 0.15 micron.

16. A photographic element according to claim 1 wherein said tabular silver iodide grains are positioned to receive exposing radiation prior to remaining of said silver halide grains.

17. A photographic element according to claim 1 wherein said tabular silver iodide grains are positioned to receive exposing radiation prior to said silver halide grains present in said red and green recording emulsion layers.

18. A photographic element according to claim 1 wherein said red and green recording emulsion layers are comprised of high average aspect ratio tabular grain emulsions and are positioned to receive exposing radiation prior to said tabular silver iodide grains and said support is a white reflective support.

19. A process of producing a multicolor photographic image comprising processing in an aqueous alkaline solution in the presence of a developing agent an imagewise exposed photographic element according to any one of claims 1 through 18.

* * * * *